US006352617B1

(12) United States Patent
Lee

(10) Patent No.: US 6,352,617 B1
(45) **Date of Patent: *Mar. 5, 2002**

(54) PULP-FORMING MOLD-RELEASING MACHINE

(76) Inventor: Vincent Lee, 7F No. 109, Sec. 6, Min-Chyuan East Rd., Ney-Hwu Area, Taipei City (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/500,912

(22) Filed: Feb. 9, 2000

(51) Int. Cl.[7] ..... D21F 1/10

(52) U.S. Cl. ..... 162/348; 162/385; 162/218; 162/382; 162/389; 162/387; 162/388; 425/85; 425/517; 425/341; 264/86; 264/542

(58) Field of Search ..... 162/348, 218, 162/382, 389, 387, 388, 385; 425/85, 517, 341; 264/86, 542

(56) References Cited

U.S. PATENT DOCUMENTS 5,972,169 A * 10/1999 Bodary et al. ..... 162/218
6,048,440 A * 4/2000 Baker ..... 162/388
6,245,199 B1 * 6/2001 Lee ..... 162/385

FOREIGN PATENT DOCUMENTS

GB 872135 * 7/1961

* cited by examiner

*Primary Examiner*—Christopher A. Fiorilla
*Assistant Examiner*—Mark Halpern
(74) *Attorney, Agent, or Firm*—Bacon & Thomas, PLLC

(57) ABSTRACT

An improved pulp-forming mold-releasing machine having a turnaround table being reciprocatingly rotatable at a pre-arranged position within the machine body. A net mold (pulp-sucking mold) includes protruding forming members on the surface thereof while the turnaround table of the machine frame body can be fitted with a lower mold (male mold) having a heating pipe therein on the other surface thereof. A reciprocating slide frame is disposed on the top of the machine frame body and includes an upper mold driving device with an air-oil-pressure diversion cylinder adapted to drive the upper mold (female mold) with a heating pipe to lift. An elevating pulp material container is disposed under the net mold of the machine frame body. The forming members of the net mold turn over to an upward direction after sucking pulp fiber.

10 Claims, 29 Drawing Sheets

PULP-FORMING MOLD-RELEASING MACHINE

BACKGROUND OF THE INVENTION

1. Field of the Invention

The present invention relates to a pulp-forming mold-releasing machine, and more particularly, to an improvement of the pulp-forming mold-releasing machine having a rotatable net mold with a lower mold at the side thereof; a downward, upward and laterally movable upper mold having an air-oil-pressure diversion cylinder therein is respectively pressed with the net mold and the lower mold together in order to enable the pulp to be formed, released from the mold, pressed for dehydration; a heating apparatus is respectively fitted to the inside of the upper and the lower mold for a proper heating in the pressing process to achieve an automation production with rapid drying and forming effect.

2. Description of the Prior Art

In consideration of the environmental protection, the modern people are more and more careful in using the difficult-decomposed materials like plastics and foam while the easy-decomposed materials like wood, paper gradually replace them. Consequently, the conventional packing and shockproof material such as sponge and foam are gradually replaced by the pulp-forming protective body.

The conventional pulp-forming machine for the paper quality protective body, as shown in FIG. 1, includes a rotatable pulp-sucking mold 73 within a machine frame 7. The pulp-sucking mold 73 has a plurality of forming members 731 protruding on the surface thereof. A vertically movable pulp container 71 is disposed under the pulp-sucking mold 73. An upper mold drive device 721 is disposed above an upper mold 72 which is vertically movable by the upper mold driving device 721. The upper mold 72 has a plurality of forming members 722 protruding on the bottom side thereof The forming members 722 has a plurality of air holes on the surface thereof through which the air comes in and goes out for creating suction force or pushing force. A conveying belt 74 extending outwards is disposed at the side of the pulp-sucking mold 73 within the machine frame 7. The whole action is performed as follows: The forming members 731 of the pulp-sucking mold 73 is downward while the pulp container 71 ascends to enable the forming members 731 to be immersed into the pulp material. When the forming members 731 suck an adequate amount of pulp on the surface thereof, the pulp container 71 descends and the pulp-sucking mold 73 reverses, and then the upper mold driving device 721 drives the upper mold 72 to descend in order for the forming members 722 to be pressed upon the forming members 731 so that the pulp on the surface of the forming members 731 is formed by pressing. Thereafter, the forming members 722 suck the formed pulp and the upper mold 72 ascends to laterally convey the formed pulp to the top of the conveying belt 74 for transport it to the next work procedure (e.g. drying process by means of heating or wind).

The above-mentioned structure can achieve the object of the automatic processing; however, the formed pulp product is dried by heating or wind immediately after the initial forming so that the fiber of the product is not closely formed (the strength is not good). Besides, a longer drying time is required for the formed pulp with high moisture content. Therefore, its production efficiency is low and this can't meet the economical requirement.

SUMMARY OF THE INVENTION

It is a primary object of the present invention to provide an improvement of the pulp-forming mold-releasing machine which has a turnaround table being reciprocatingly rotatable at a prearranged position within the machine frame body, a net mold with a plurality of protruding forming members on the surface thereof while the turnaround table of the machine frame body can be fitted with a lower mold having a heating pipe therein on the other surface thereof; a reciprocatingly slide frame disposed on the top of the machine frame body and having an upper mold driving device with an air-oil-pressure diversion cylinder to drive the upper mold with a heating pipe to lift; an elevating pulp material container disposed under the net mold of the machine frame body; the forming members of the net mold turn over to be upward after sucking pulp fiber; thereafter, the upper mold presses thereon for dehydration and then sucks the formed pulp pieces and is elevated for releasing mold while the slide frame is laterally shifted to place the formed pulp piece upon the lower mold having a heating pipe therein, then a compulsory press is performed in a oil pressure way by means of a air-oil-pressure diversion cylinder prearranged within the upper mold lifting device to enable the pulp fiber within the formed pulp piece more closely and more dehydrated; moreover, the pulp can be heated by heating pipes in order to achieve a rapid drying effect.

It is a further object of the present invention to provide an improvement of the pulp-forming mold-releasing machine wherein the net mold is fitted with at least one lower mold at the side thereof, and wherein the lower mold is provided with a upper press mold of corresponding amount at the upper side symphonically movable with the upper mold, and wherein the synchronic motion between the upper press mold and the upper mold enables the formed pulp pieces continuously movable on each lower mold and enables them to be repeatedly pressed by each upper press mold in order to achieve a better dehydrated effect.

It is another object of the present invention to provide an improvement of the pulp-forming mold-releasing machine wherein the turnaround table has the net mold fixed at one side thereof and a lower mold at the other side thereof; when the water of the pulp is squeezed out at the initial press between the net mold and the upper mold; the turnaround table will immediately turn to enable the lower mold at the other side of the turnaround table and the upper mold to press together while the heating pipes within the upper mold and the lower mold create a thermal effect in order to speed up the drying process of the water within the formed pulp piece; this kind of structure can save the equipment of the lower mold fitted to the original machine frame body and effectively reduce the whole mechanical volume and the number of components.

BRIEF DESCRIPTION OF THE DRAWINGS

The drawings disclose illustrative embodiments of the present invention which serve to exemplify the various advantages and objects hereof, and are as follows.

DETAILED DESCRIPTION OF THE PREFERRED EMBODIMENT

Figure 1:
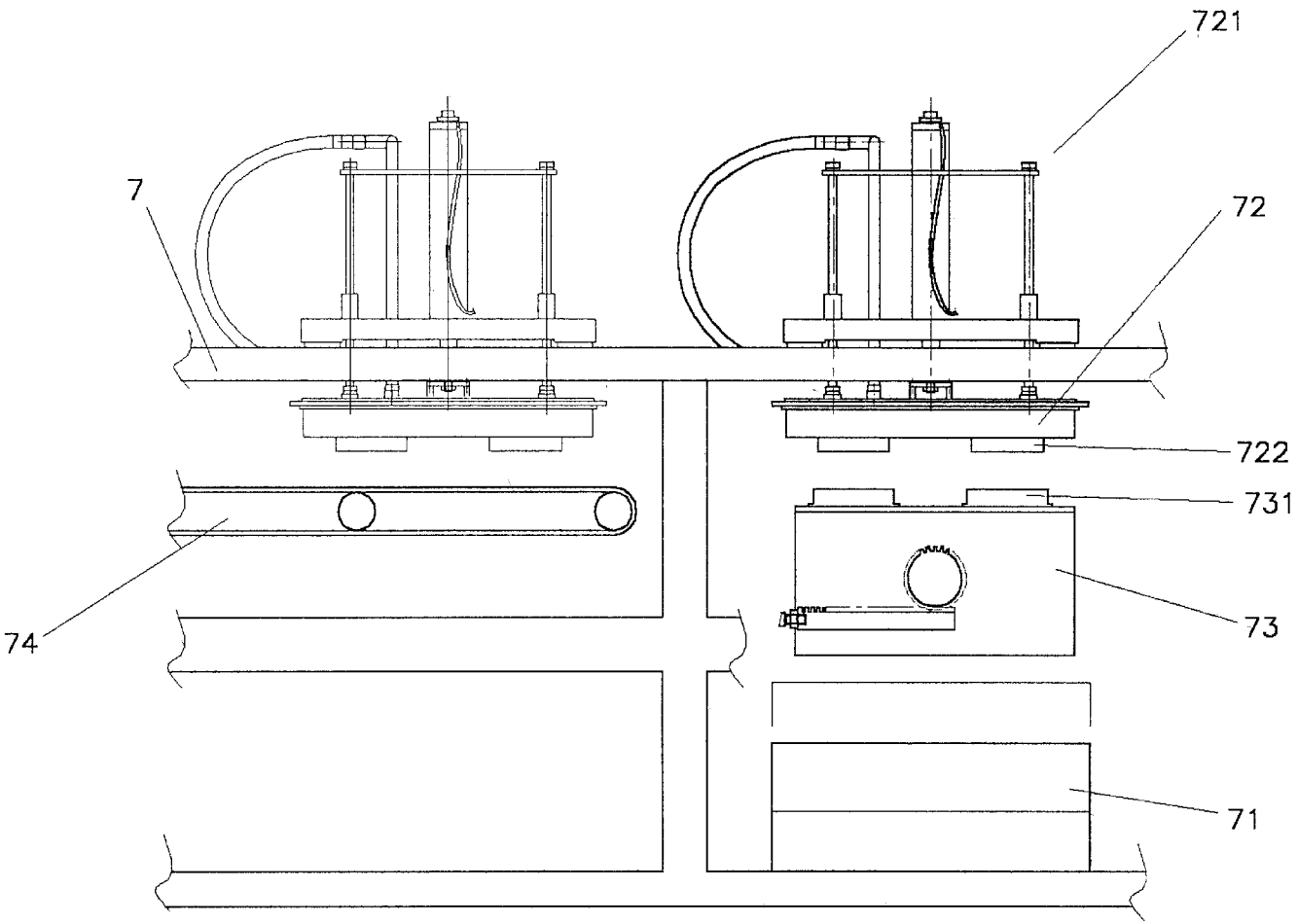
Fig. 1 PRIOR ART
FIG. 1 is a schematic drawing of the structure of prior art pulp-forming mold-releasing machine.

As shown in FIG. 1, the configurations and the disadvantages of the conventional pulp-forming mold-releasing machine have been described above and won't repeat hereafter.

Figure 2A:
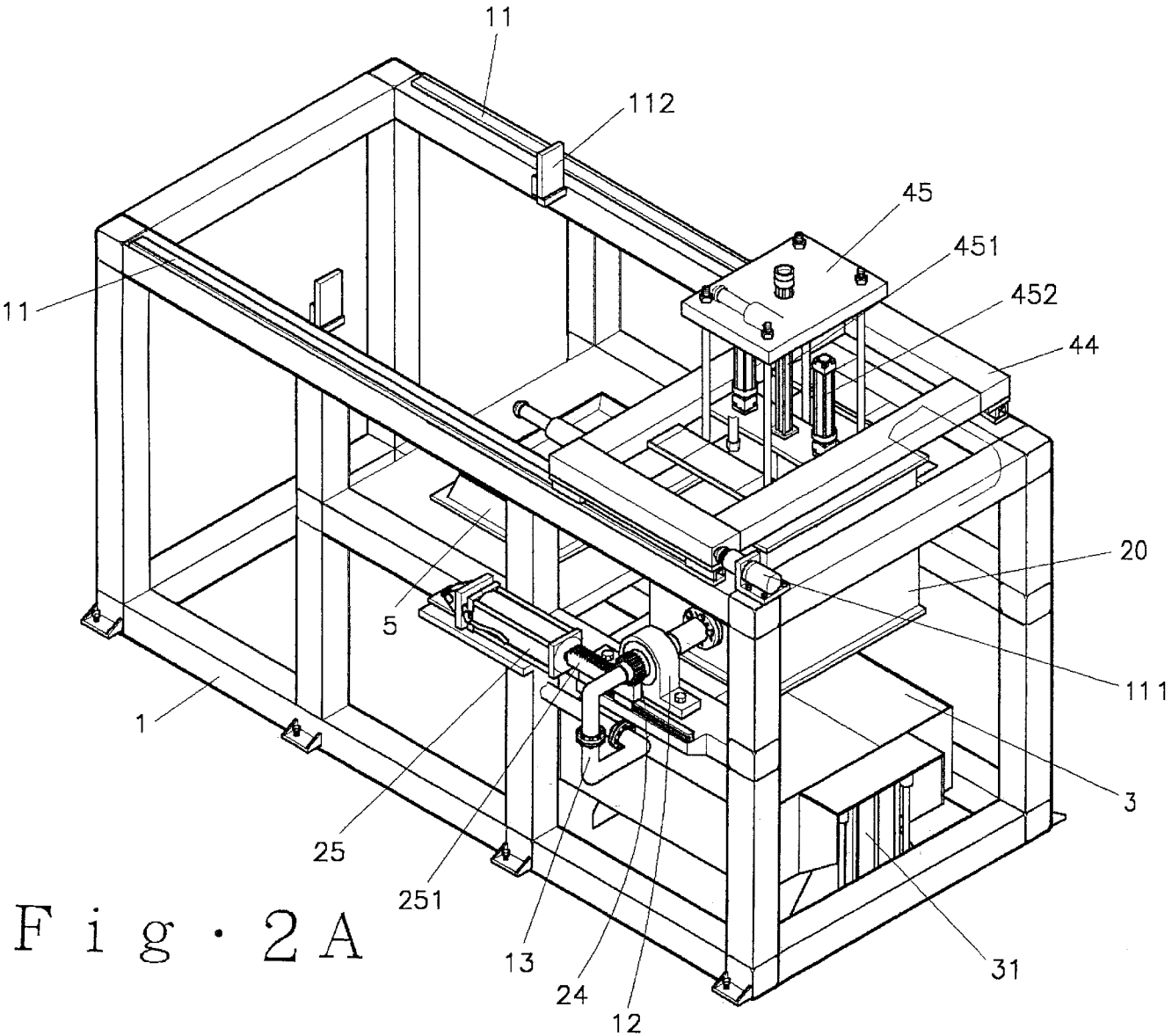
FIG. 2A is a perspective assembly view of a first preferred embodiment of the present invention.
Figure 2B:
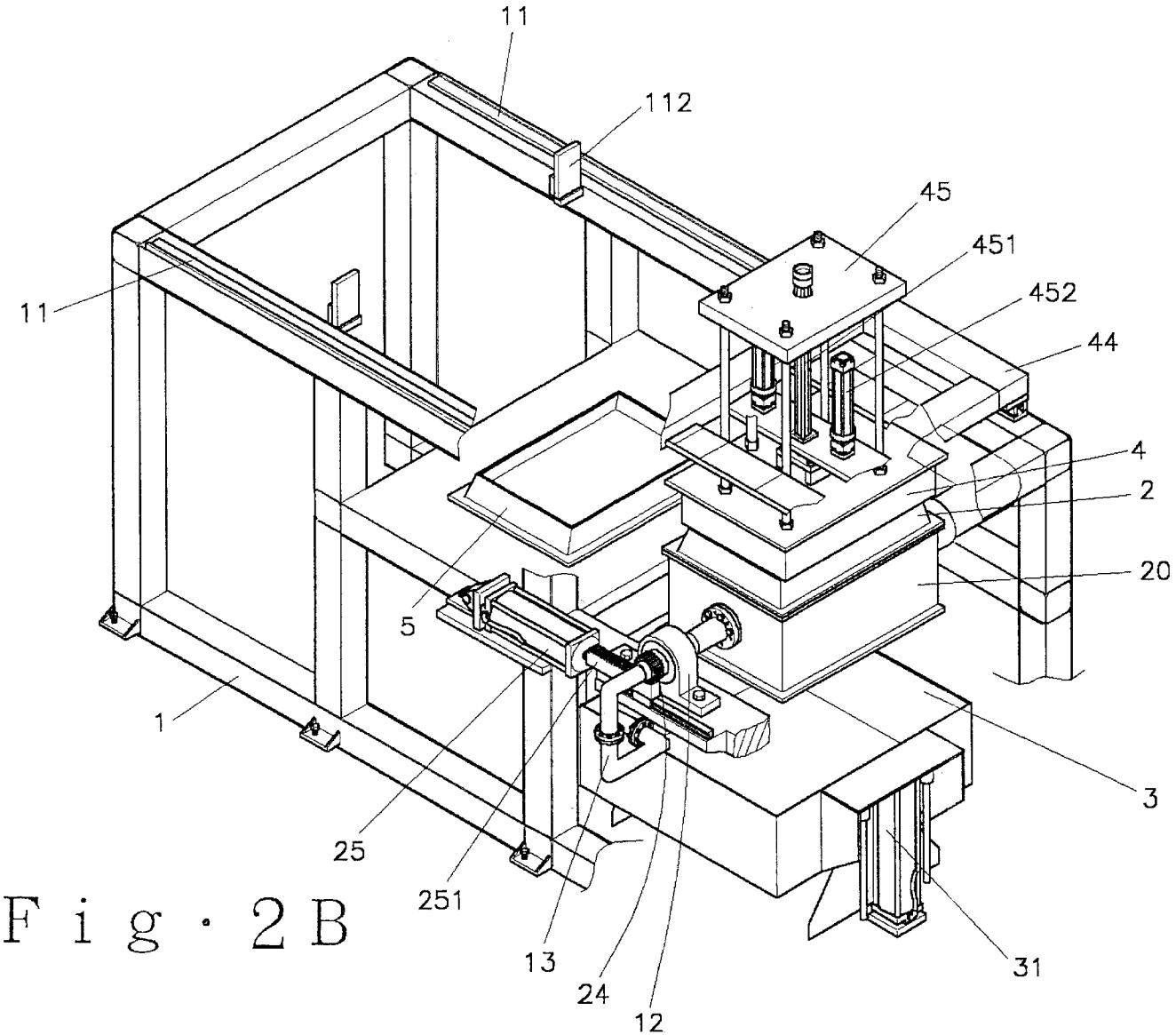
FIG. 2B is a partial perspective assembly view of the first preferred embodiment of the present invention.

FIG. 2A and 2B show a whole and a partial assembly view of a first preferred embodiment of the present invention. It's apparent from the drawings that the present invention includes a machine frame body 1, a net mold 2, a pulp material container 3, an upper mold 4 and a lower mold 5. The upper side of the machine frame body 1 is fitted with two parallel extending guide rails 11 having a shock absorber 111 at the end thereof and an end stop 112 at one side thereof. Two sides of the middle section of the machine frame body 1 respectively contain a bearing blocks 12 corresponding to the guide rails 11 and approx. equal to the guide rails 11 in width. A vent pipe 13 is disposed at the center of the bearing block 12 in order to connect to the outside. The net mold 2 is mounted on one surface of the turnaround table 20, and the turnaround table 20 has a pipe shaft 21 outward and laterally disposed at two sides of the middle section thereof respectively and penetrating through a prearranged bearing within the above-mentioned bearing block 12; moreover, the pipe shaft 21 is connected with the vent pipe 13. Therefore, the turnaround table 20 with the net mold 2 can be rotatable on the pipe shaft 21 to create a hinge joint. The pipe shaft 21 includes a toothed wheel 24 at one end thereof, and the bearing block 12 has a toothed drive bar 251 of a rotatable driving device 25 at one side thereof while the toothed wheel 24 is engaged with the toothed drive bar 251. The pulp material container 3 is disposed under the net mold 2 and two sides thereof are upwards and downwards movable by means of at least two lifting devices 31 for the pulp material container 3. The upper mold 4 is disposed above the net mold 2, connected with a lifting devices 45 for the upper mold 4 and located on a slide frame 44. The lifting devices 45 for the upper mold 4 includes an air-oil-pressure diversion cylinder 451 and a pneumatic pressure cylinder 452. The slide frame 44 is placed on the two guide rails 11 and movable on the guide rails 11 by means of a lateral shifting device (not shown) for the upper mold; besides, the upper mold 4 is reciprocatingly upwards and downwards movable by means of the lifting devices 45 for the upper mold 4. The lower mold 5 is disposed at a position with equal height to the net mold 2.

Figure 3:
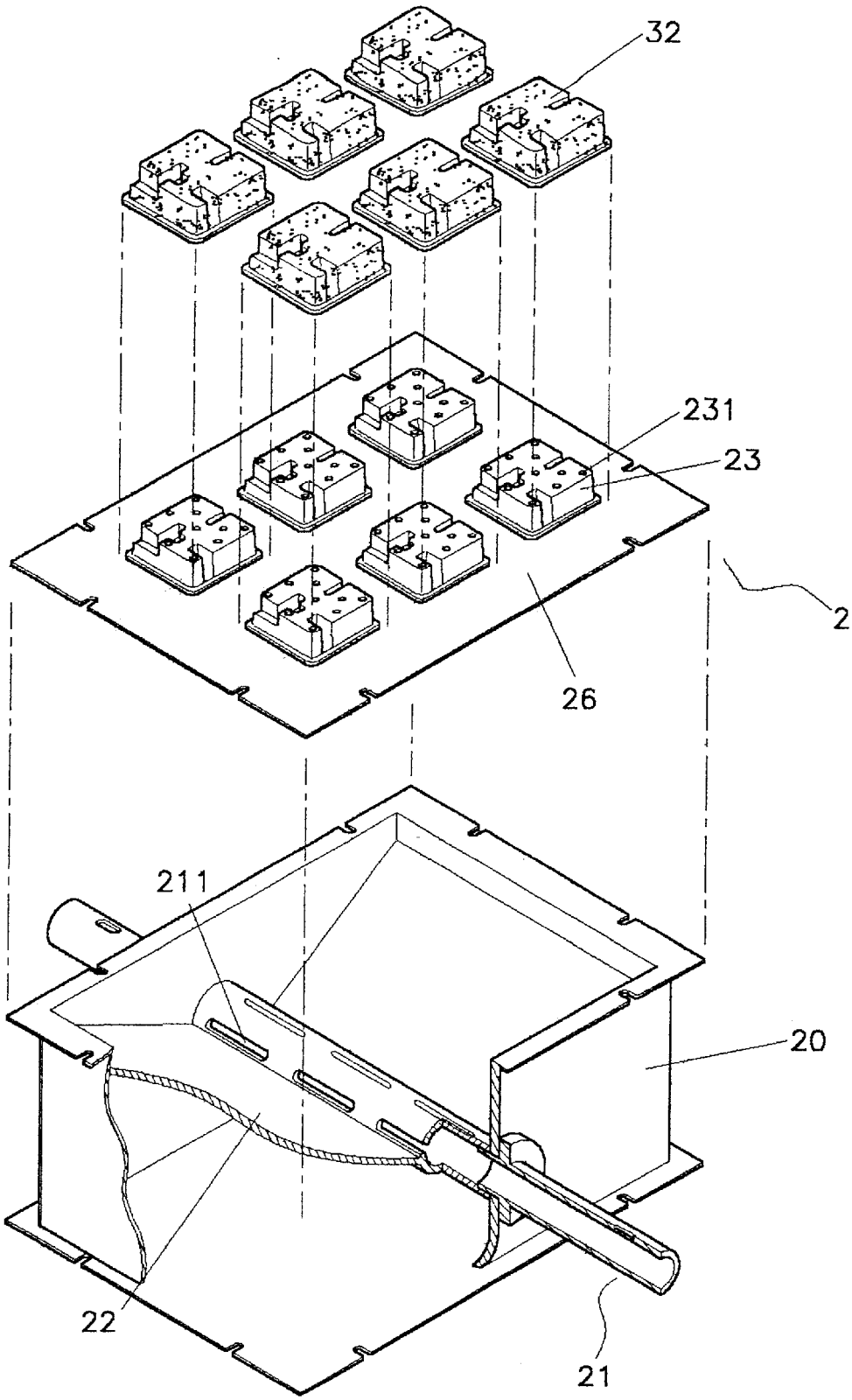
FIG. 3 is an exploded view of a net mold of the present invention.

FIG. 3 shows an exploded view of the net mold of the present invention. It's apparent from this drawing that a slanting partition 22 is laterally disposed at the middle section of the net mold 2, and that the pipe shaft 21 extending outward is respectively disposed at two sides of the net mold 2 while the pipe shaft 21 is connected through the air holes 211 to the space at the top of the slanting partition 22. The net mold 2 contains a net mold seat plate 26 at the top thereof having a plurality of forming members 23 each of which contains a plurality of air holes 231 through which the space at the top of the slanting partition 22 can be connected to the outside.

Figure 4:
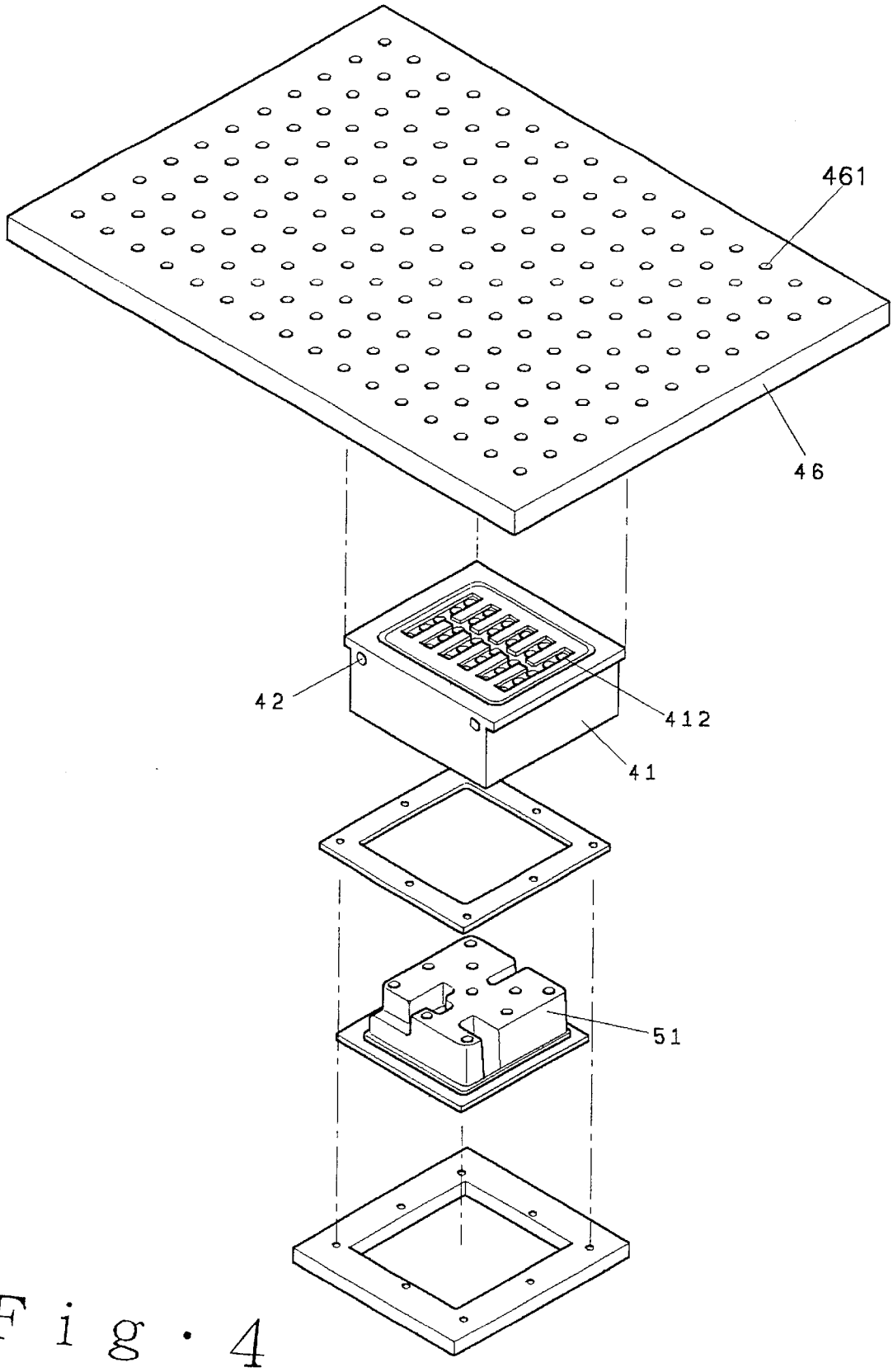
FIG. 4 is an exploded view of an upper mold of the present invention.

FIG. 4 shows an exploded view of the upper mold of the present invention. It's apparent from the drawing that the upper mold 4 contains an upper mold seat plate 46 at the bottom side thereof on which a plurality of breather holes 461 are well-distributed. A plurality of forming members 41 protrude over the upper mold seat plate 46 and contain a forming space 411 corresponding to the forming members 23 of the net mold 2. A plurality of air holes 412 are disposed within the forming space 411 and are connected through breather holes 461 to a vent pipe 43 of the upper mold 4 (see FIG. 5A) while it is connected to the outside through the vent pipe 43. The pressing formed pulp piece 32 will be effectively sucked by means that the vent pipe 43 inhales and exhales, and the forming members 41 is provided with a heating pipe 42 therein.

Figure 5A:
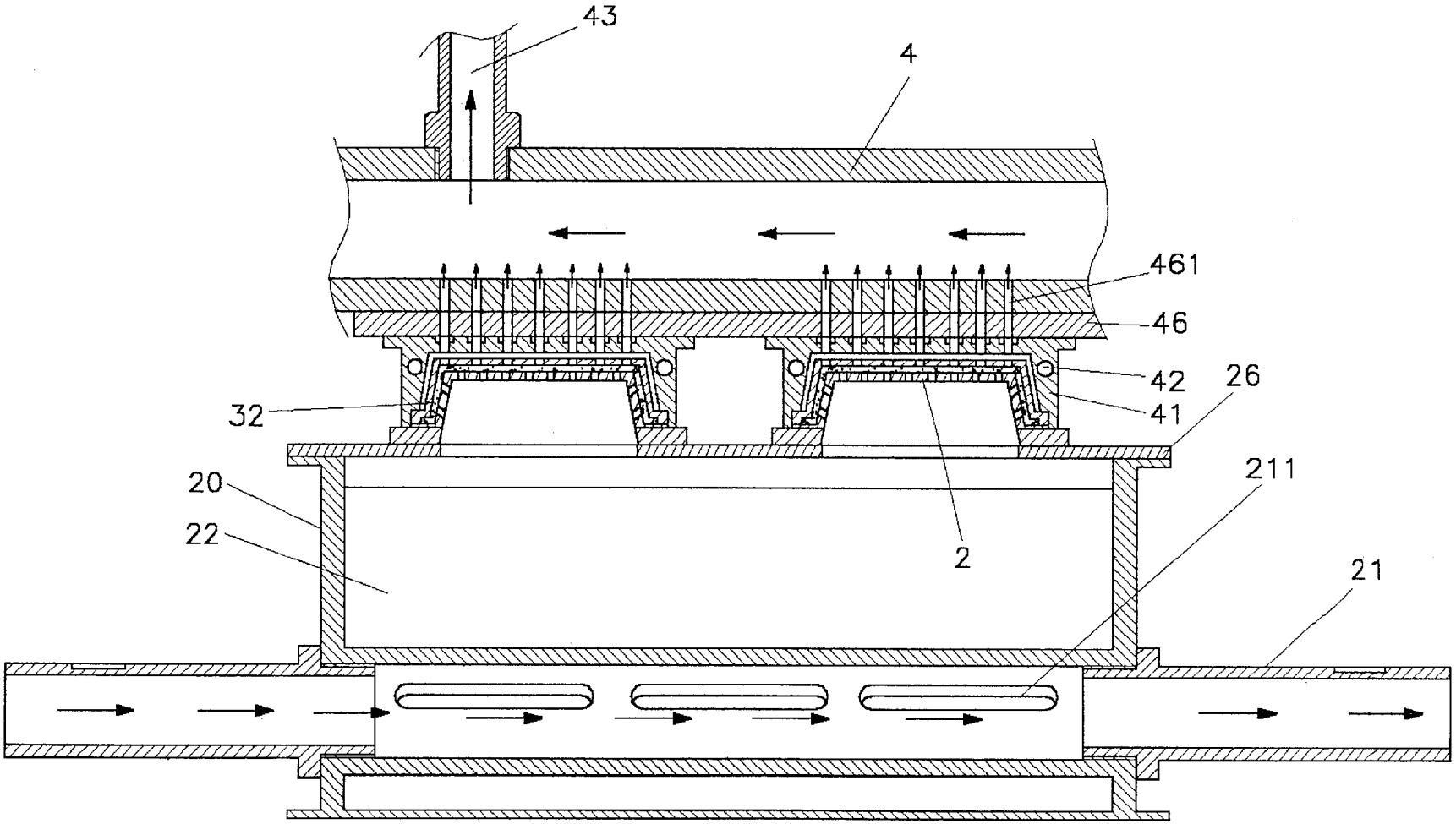
FIG. 5A is a sectional view of the upper mold and the net mold in accordance with the present invention when they are pressed together.
Figure 5B:
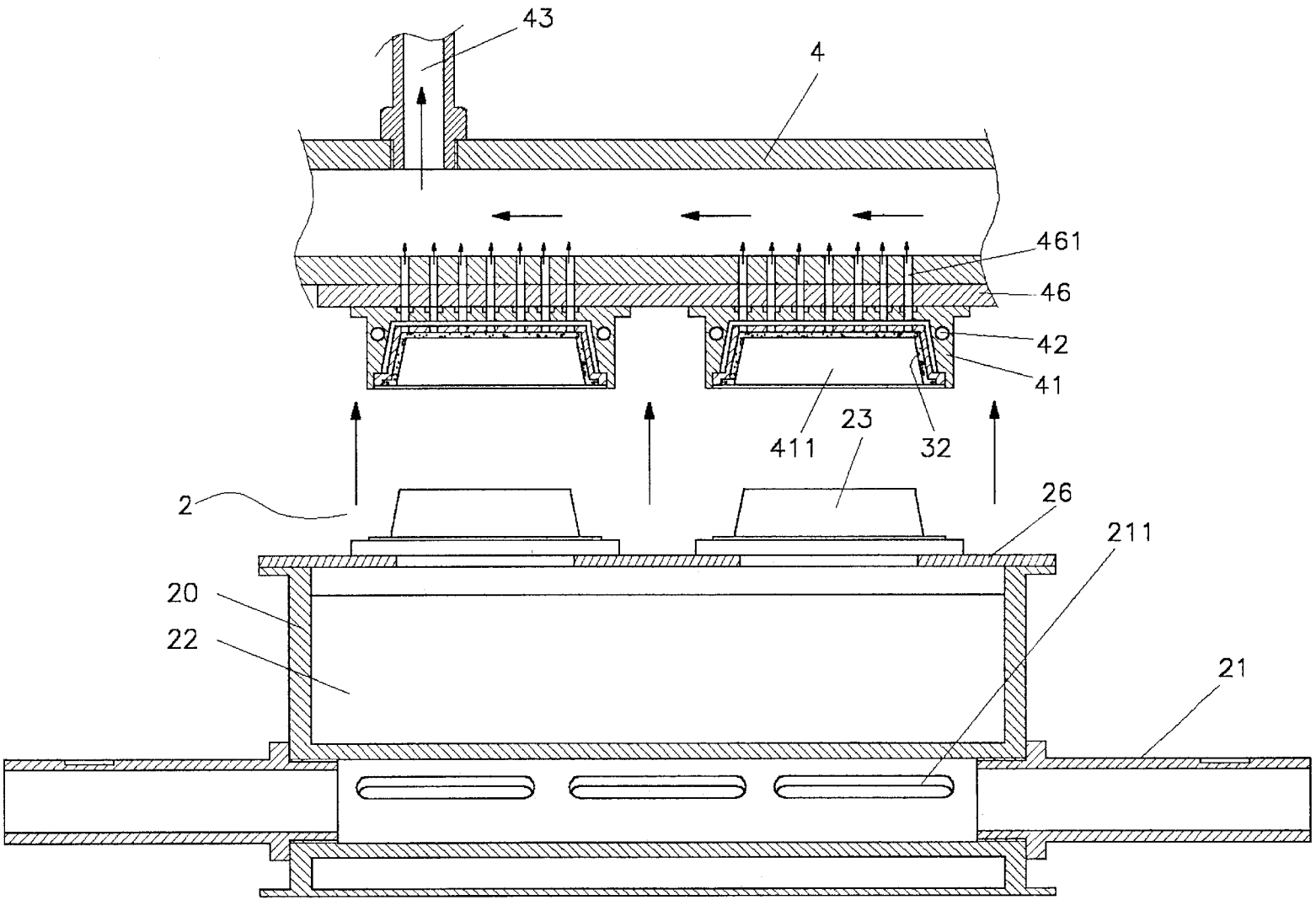
FIG. 5B is a sectional view of the upper mold and the net mold in accordance with the present invention when they are separated.

FIG. 5A and 5B show sectional views of the upper mold and the net mold in accordance with the present invention when they are pressed together and separated. It's apparent from these two drawings that, when the forming members 41 are preheated by the heating pipe 42 and pressed with the forming members 23 together, the heated vapor of the formed pulp piece 32 within the forming space 411 will be pumped through the vent pipe 43, inhaled through the breather holes 461 and the air holes 412, pumped in cooperation of the pipe shaft 21 and inhaled through ventilation hole 211 for expelling it out. After the formed pulp piece 32 is properly dried, the pipe shaft 21 stops pumping air and the formed pulp piece 32 is sucked and attached to the inside of the forming space 411 of the forming members 41 by means of the suction of the breather holes 461 while the formed pulp piece 32 is synchronically shifted to another place.

Figure 6A:
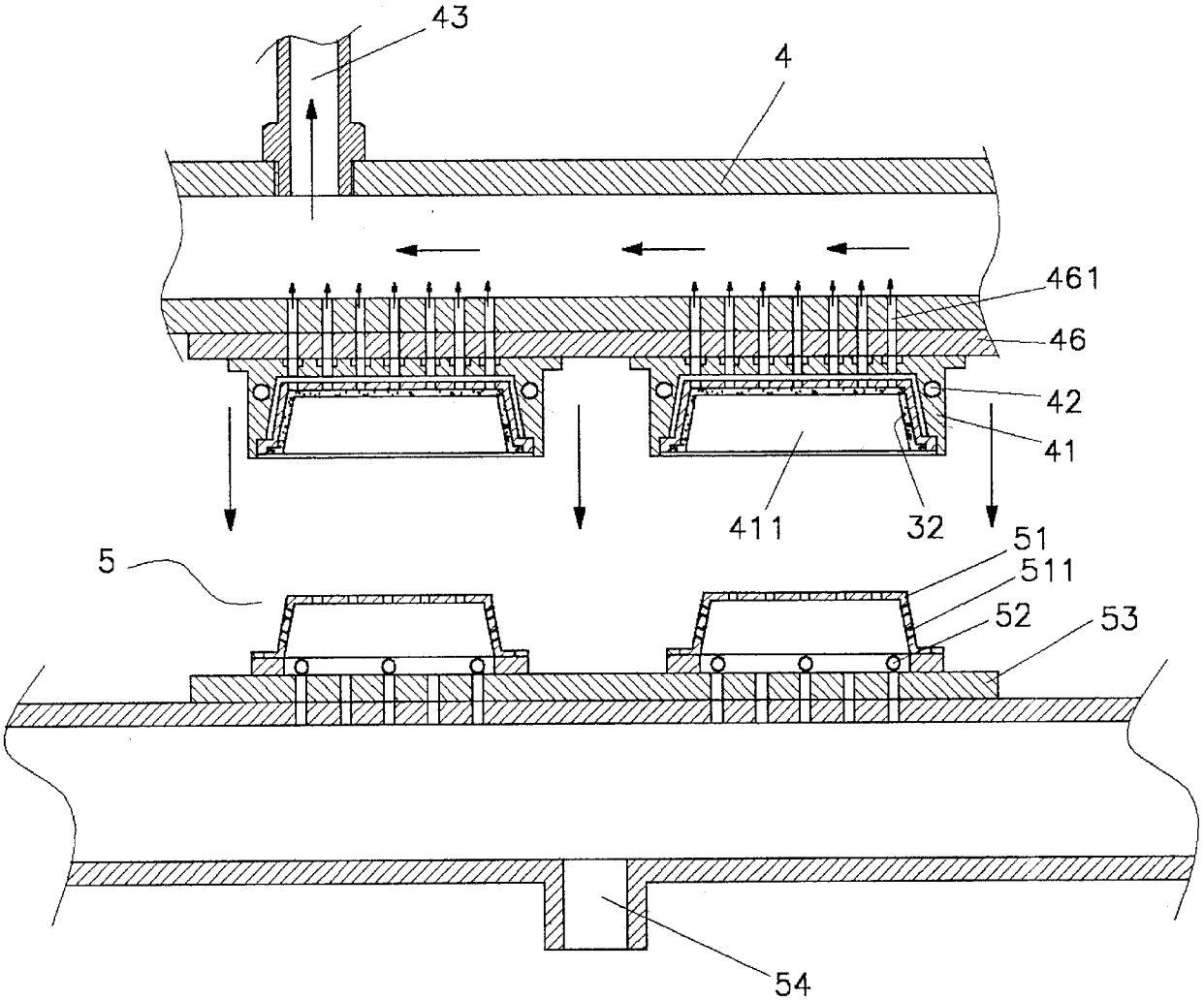
FIG. 6A is a sectional view of the upper mold and the lower mold in accordance with the present invention when they are separated.
Figure 6B:
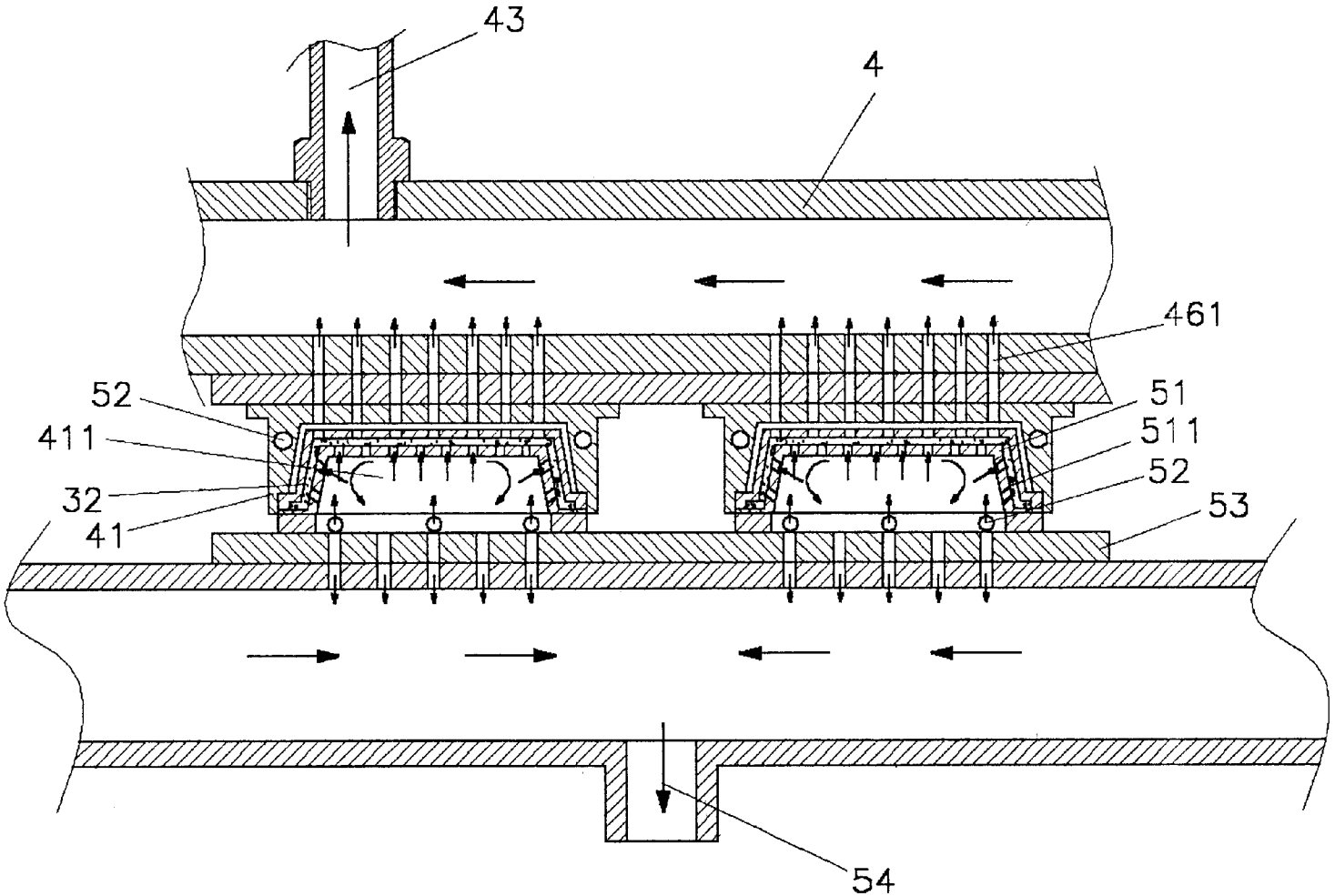
FIG. 6B is a sectional view of the upper mold and the lower mold in accordance with the present invention when they are pressed together.

FIG. 6A and 6B show sectional views of the upper mold and the lower mold in accordance with the present invention when they are separated and pressed together. It's apparent from these two drawings that the lower mold 5 is connected by means of a lower mold seat plate 53 with a plurality of forming members 51 each of which has a plurality of air holes 511 on the surface thereof each of which is connected to the inside of the lower mold 5 and to an air extracting equipment by through a ventilation pipe 54; besides, the forming members 51 is fitted with a heating pipe 52 therein. When the forming members 41 sucks the formed pulp piece 32 to the top of the forming members 51 of the lower mold 5 in place and stops, the upper mold 4 descends so that the formed pulp piece 32 within the forming space 411 is joined on the forming members 51; thereafter, the heating pipe 52 in the forming members 51 together with the heating pipe 42 of the forming members 41 synchronically heat the formed pulp piece 32 for a further drying. The ventilation pipe 54 in cooperation with the vent pipe 43 synchronically extracts and exhausts air in order to exhaust the heated vapor of the formed pulp piece 32.

Figure 7A:
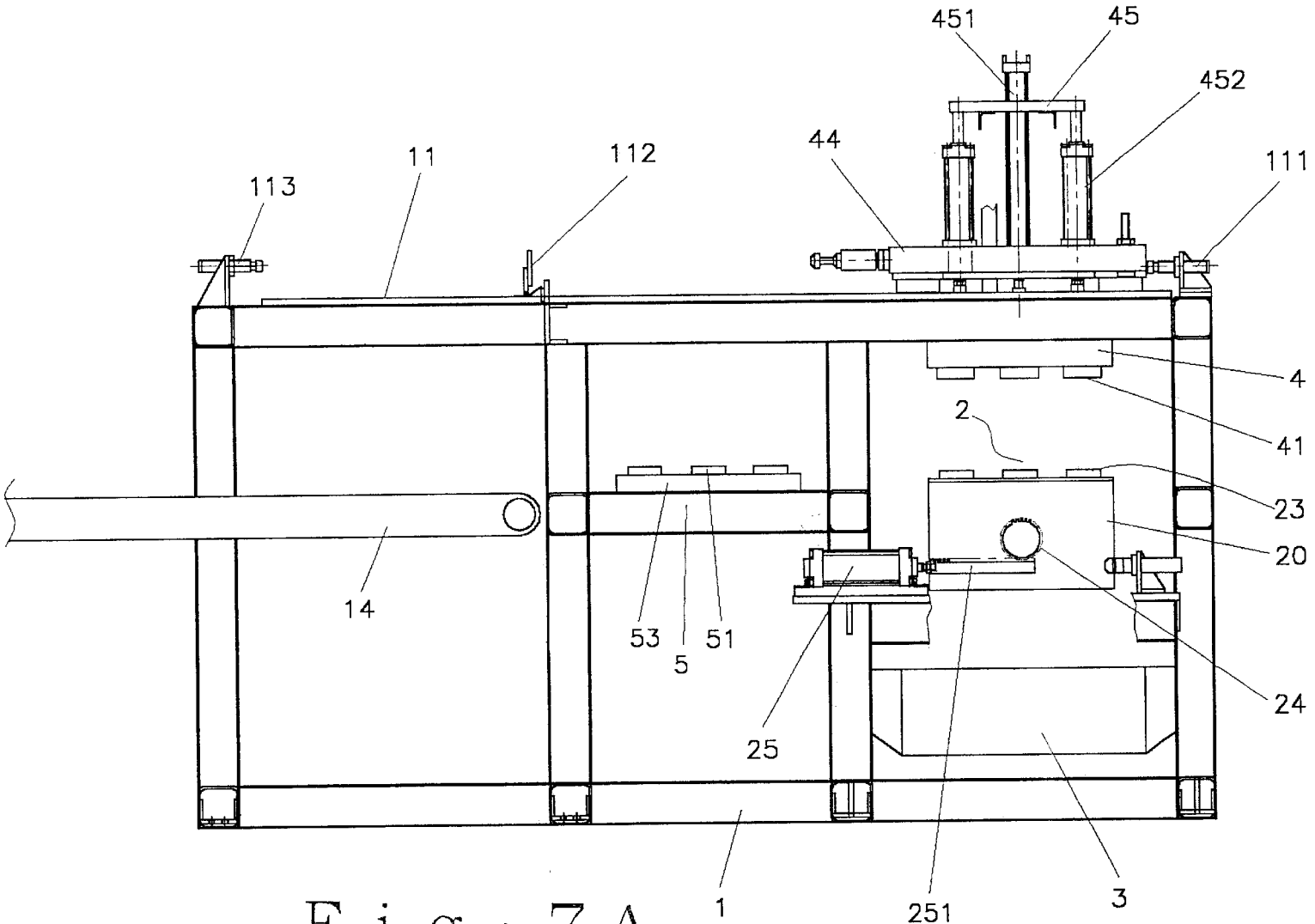
FIG. 7A is a first schematic drawing of the movement of a first preferred embodiment of the present invention.
Figure 7B:
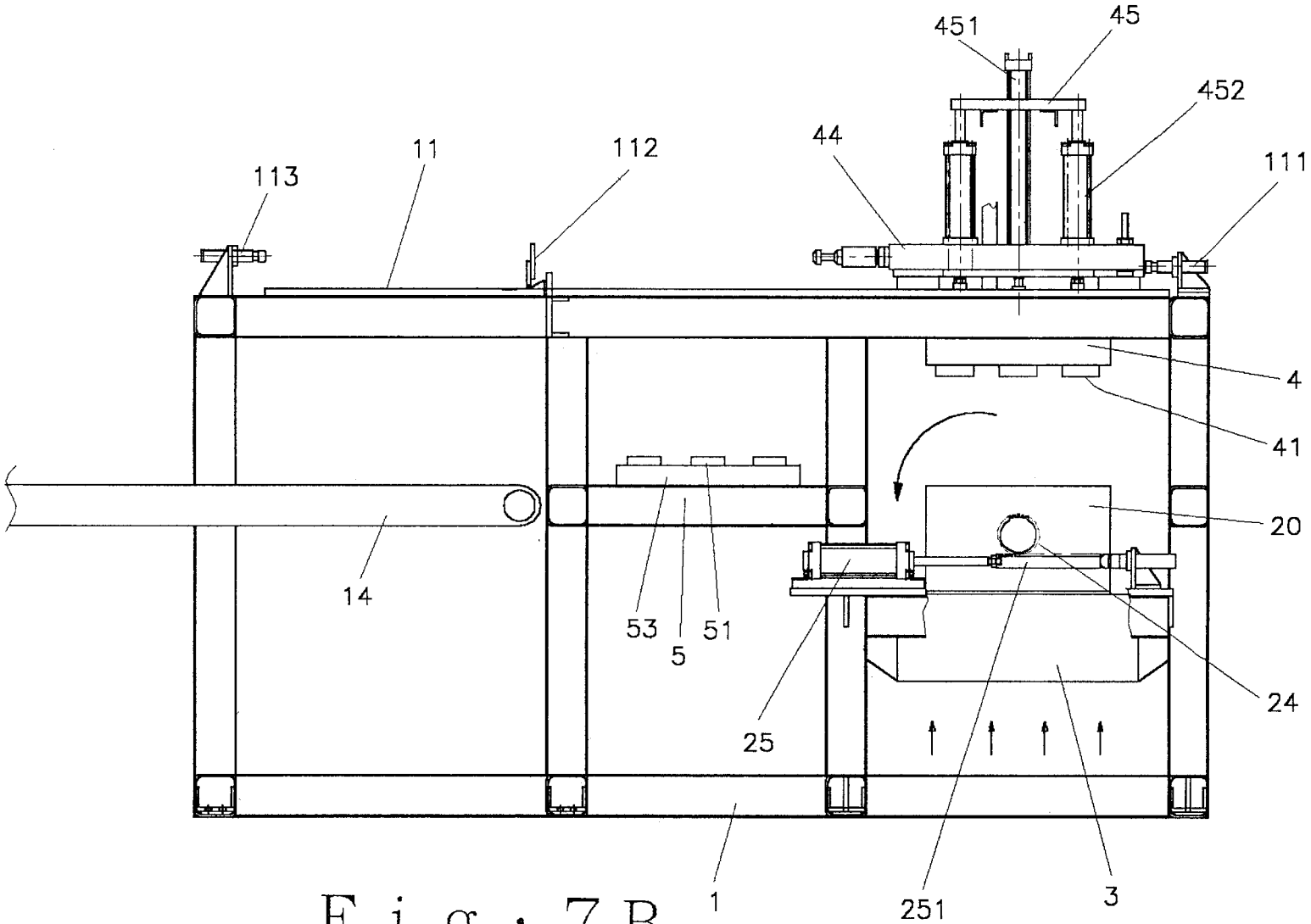
FIG. 7B is a second schematic drawing of the movement of the first preferred embodiment of the present invention.
Figure 7C:
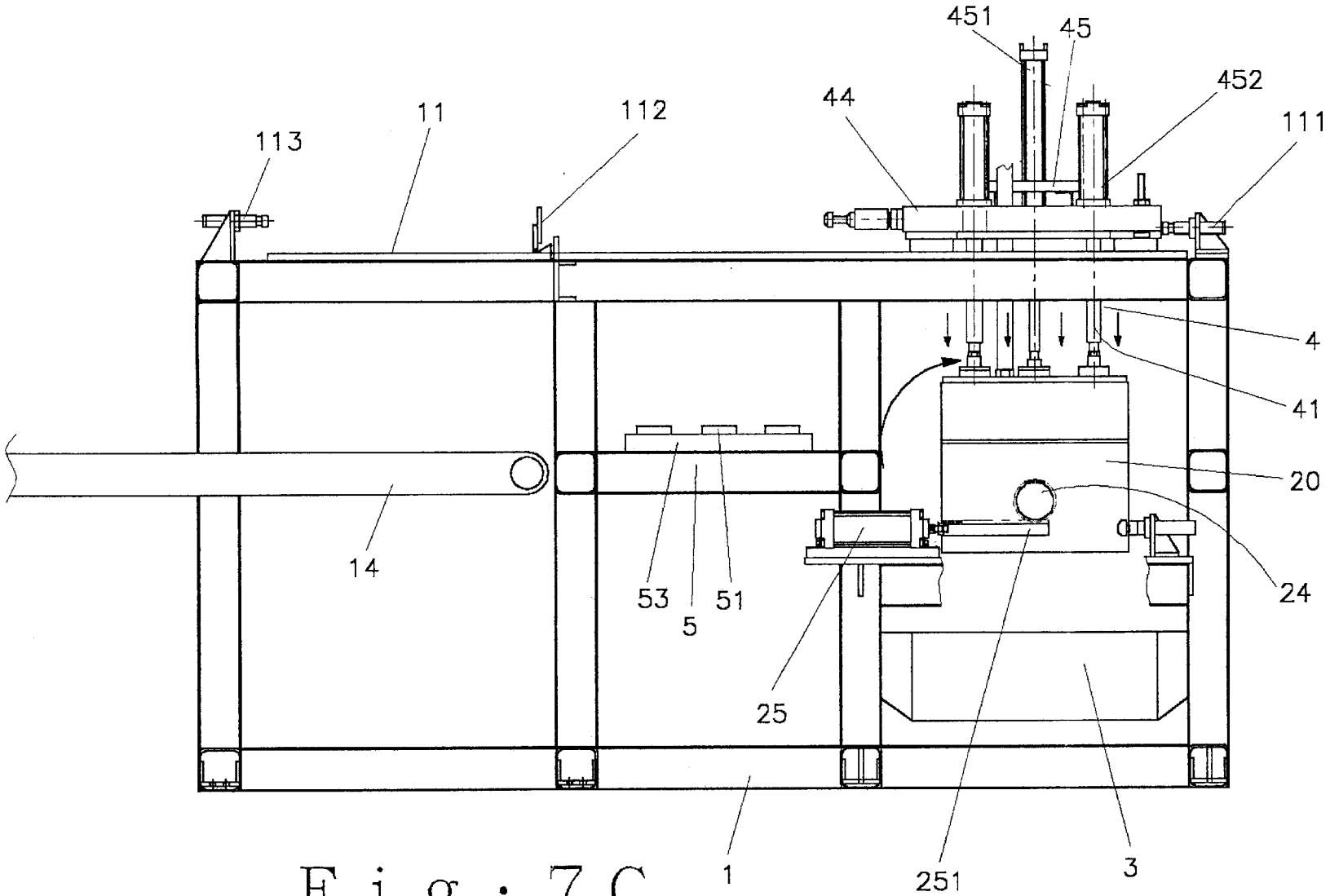
FIG. 7C is a third schematic drawing of the movement of the first preferred embodiment of the present invention.
Figure 7D:
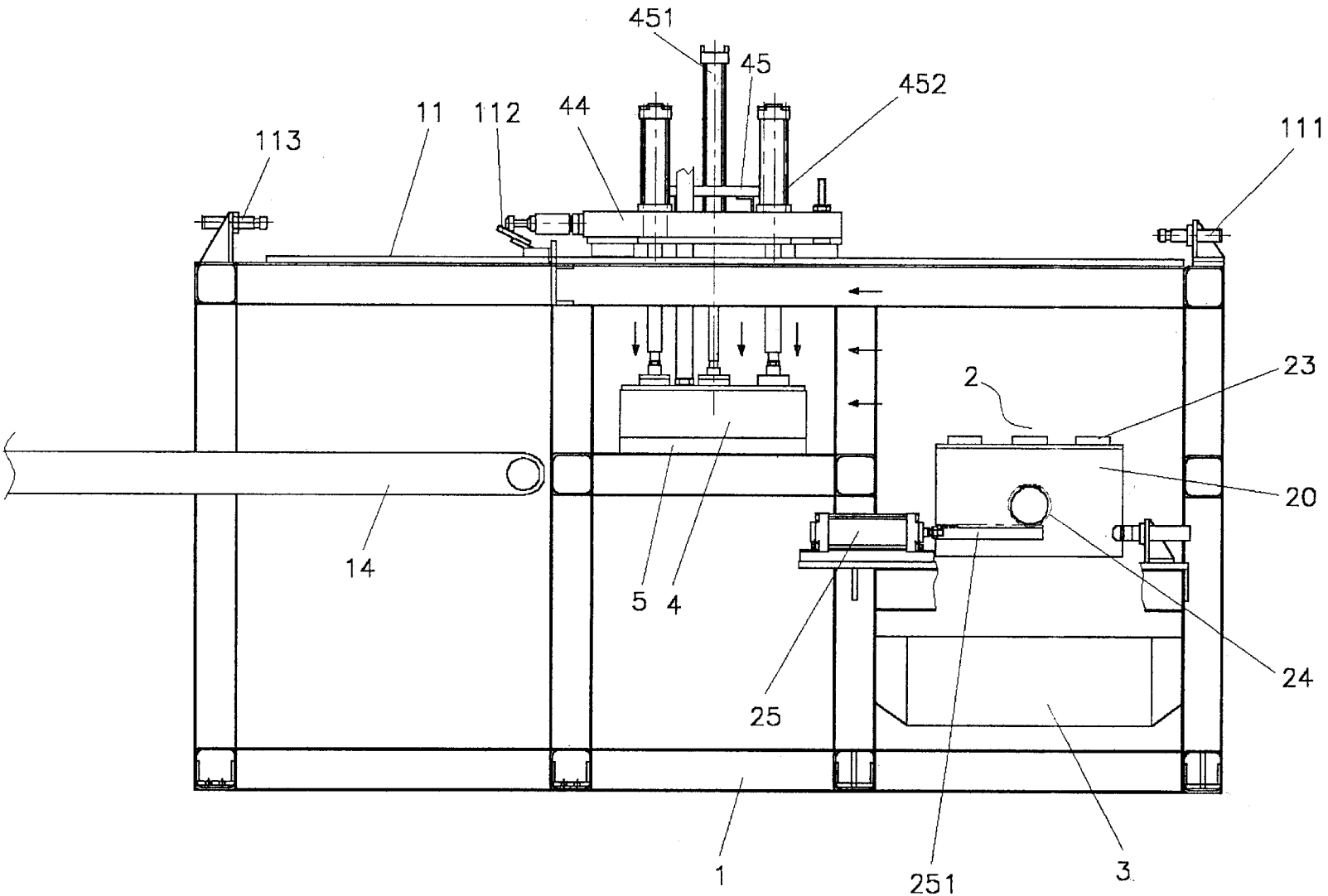
FIG. 7D is a fourth schematic drawing of the movement of the first preferred embodiment of the present invention.
Figure 7E:
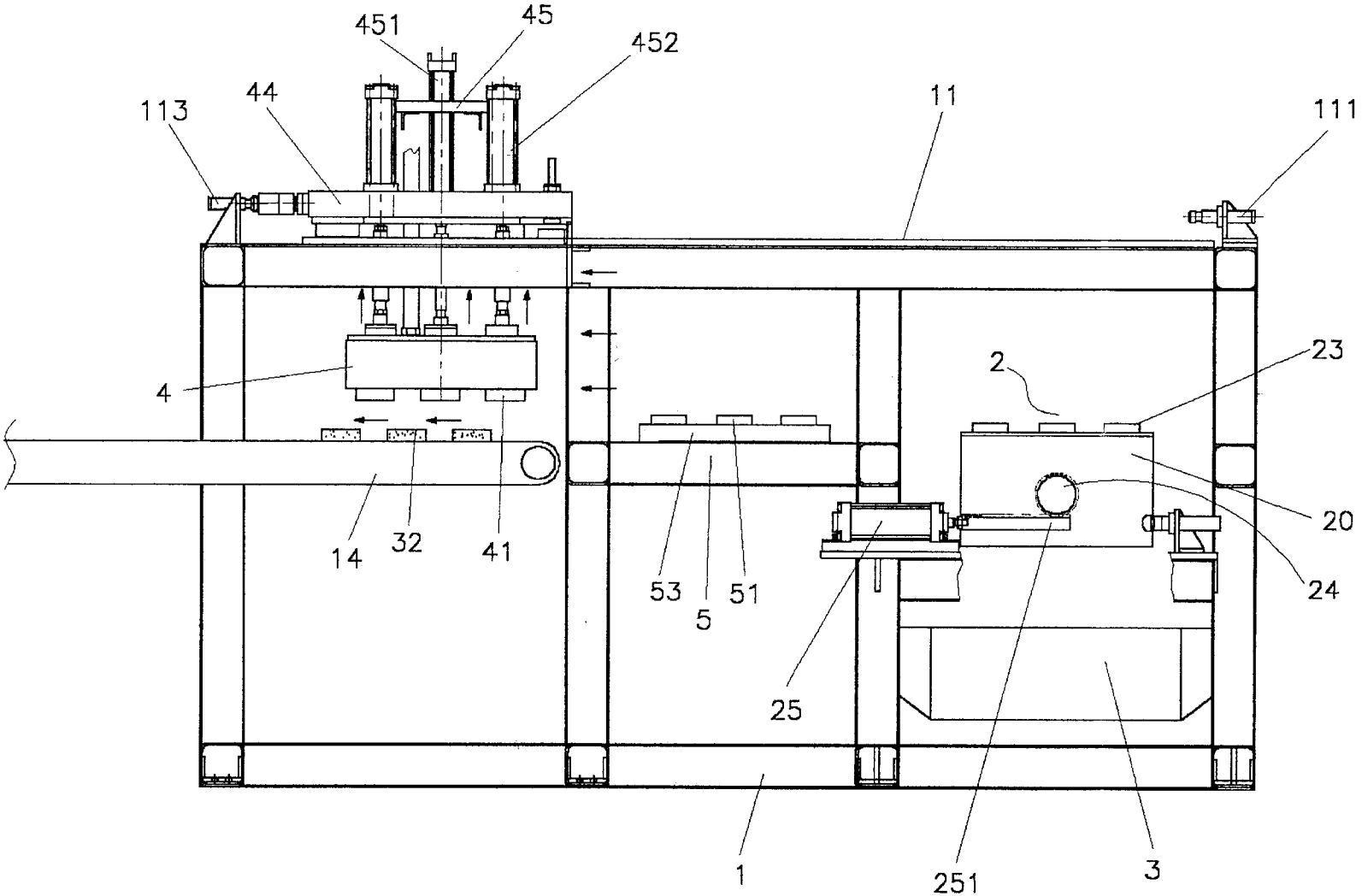
FIG. 7E is a fifth schematic drawing of the movement of the first preferred embodiment of the present invention.

FIG. 7A through 7E are schematic drawings of the movement of the first preferred embodiment of the present invention. FIG. 7A shows an initial condition. In the beginning, the rotatable driving device 25 is actuated, and the toothed drive bar 251 and the toothed wheel 24 bring the net mold 2 in rotation in order to enable the forming members 23 downwards. At that time, the lifting devices 31 for the pulp material container 3 is actuated to push the pulp material container 3 upwards until the forming members 23 are completely immersed into the pulp material within the pulp material container 3. Then, the vent pipe 13 begins to pump air in order to enable the inside of the net mold 2 to create a vacuum state. By means of the suction action of the air holes 231, the pulp material can be well distributed and attached round the side of the forming members 23, as shown in FIG. 7B. Thereafter, the pulp material container 3 descends, the rotatable driving device 25 works in a reverse direction to reverse the net mold 2 (the forming members 23 is upward) while the action of the lifting devices 45 for the upper mold 4 enables the upper mold 4 to descend, and the forming space 411 of the forming members 41 is attached with the forming members 23 of the net mold 2 so that the pulp material sucked on the surface of the forming members 23 can be slightly pressed to be the formed pulp piece 32 (see FIG. 7C and refer to FIG. 4A). At that time, the heating pipe 42 within the upper mold 4 has been pre-heated and the formed pulp piece 32 is speeded up to be formed through the raised temperature. After the formed pulp piece 32 is initially solidified and formed, the lifting devices 45 for the upper mold 4 moves in a reverse direction to enable the upper mold 4 upwards while the forming members 41 of the upper mold 4 are separated from the forming members 23 of the net mold 2. Meanwhile, the vent pipe 43 begins to pump air in order that the formed pulp piece 32 is attached into the forming space 411 of the forming members 41, as shown in FIG. 5B. The cross shift device for the upper mold is moved to enable the upper mold 4 to slide, and when the upper mold 4 touches the end stop 112 (while the upper mold 4 is situated over the lower mold 5), the lifting devices 45 for the upper mold 4 is moved again to enable the upper mold 4 downwards. After the air-oil-pressure diversion cylinder 451 in cooperation with the pneumatic pressure cylinder 452 in the air pressure way drives the forming space 411 of the forming members 41 to be pressed upon the fixed forming members 51 of the lower mold 5 (as shown in FIG. 7D), the drive will be changed to be in an oil pressure way by the air-oil-pressure diversion cylinder 451 in order to increase the pressure of the upper mold 4 upon the lower mold 5 so that the fiber within the formed pulp piece 32 can be more closely formed. Thereafter, the formed pulp piece 32 is sucked by the forming members 41 of the upper mold 4, and the cross shift device for the upper mold (the end stop 112 is horizontally situated now.) is moved to enable the upper mold 4 to shift to touch a shock absorber 113 (while the upper mold 4 is situated over the conveying belt 14) so that the vent pipe 43 stops to pump air while the formed pulp piece 32 falls down to the conveying belt 14 and is conveyed to the next work procedure, as shown in FIG. 7E).

Figure 8:
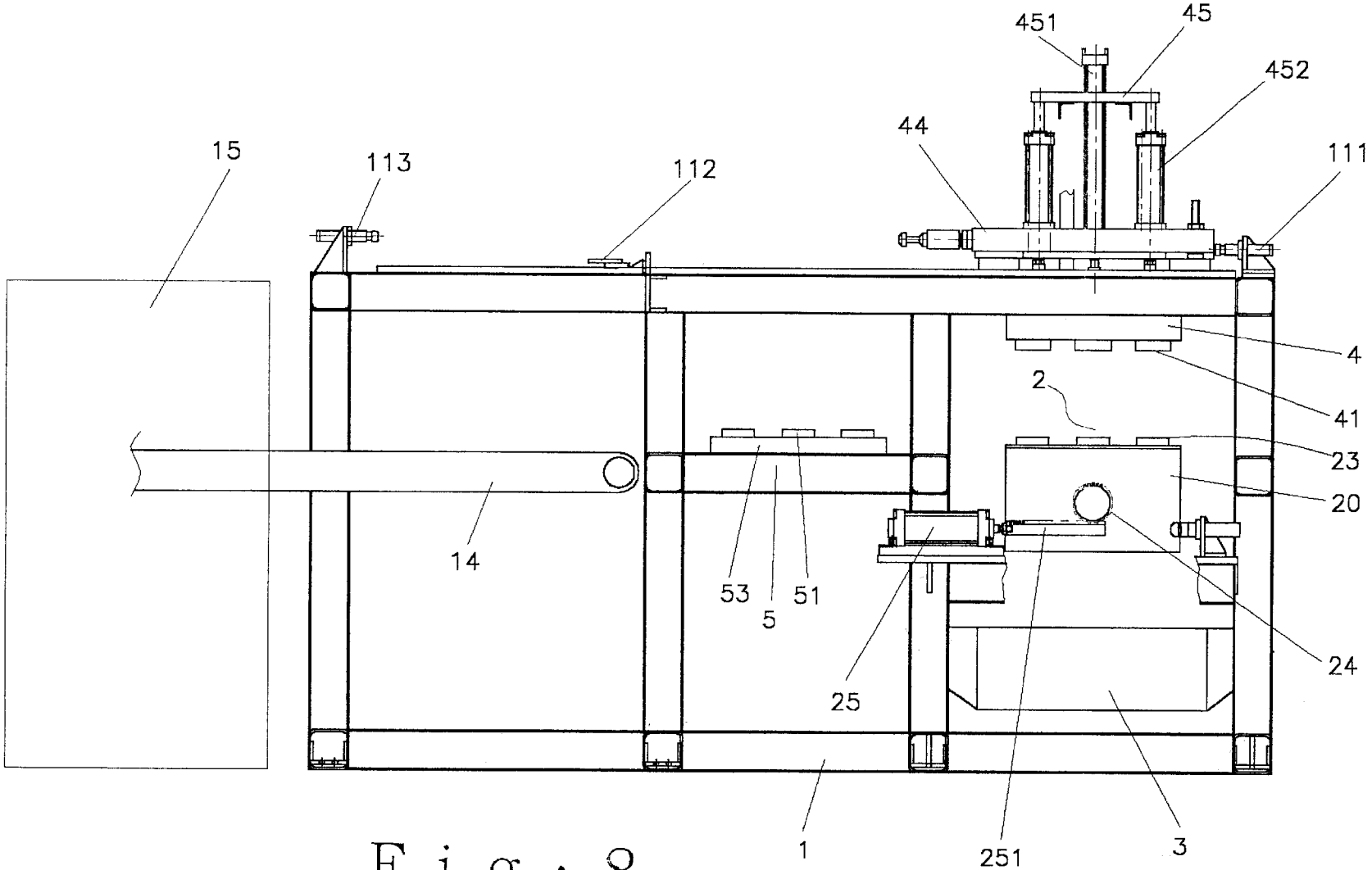
FIG. 8 is a schematic drawing of the movement of a second preferred embodiment of the present invention.

FIG. 8 is a schematic drawing of the movement of the second preferred embodiment of the present invention. It's apparent from the drawing that the end stop 112 can be adjusted in a horizontal fixed condition. At that time, after the upper mold 4 finishes the above-mentioned process of FIG. 7C, it can directly convey the formed pulp piece 32 to the upper side of the conveying belt 14 while the formed pulp piece 32 falls down on the conveying belt 14 in order that the formed pulp piece 32 can be shifted by the conveying belt 14 to the inside of the prearranged stove 15 for drying.

Figure 9:
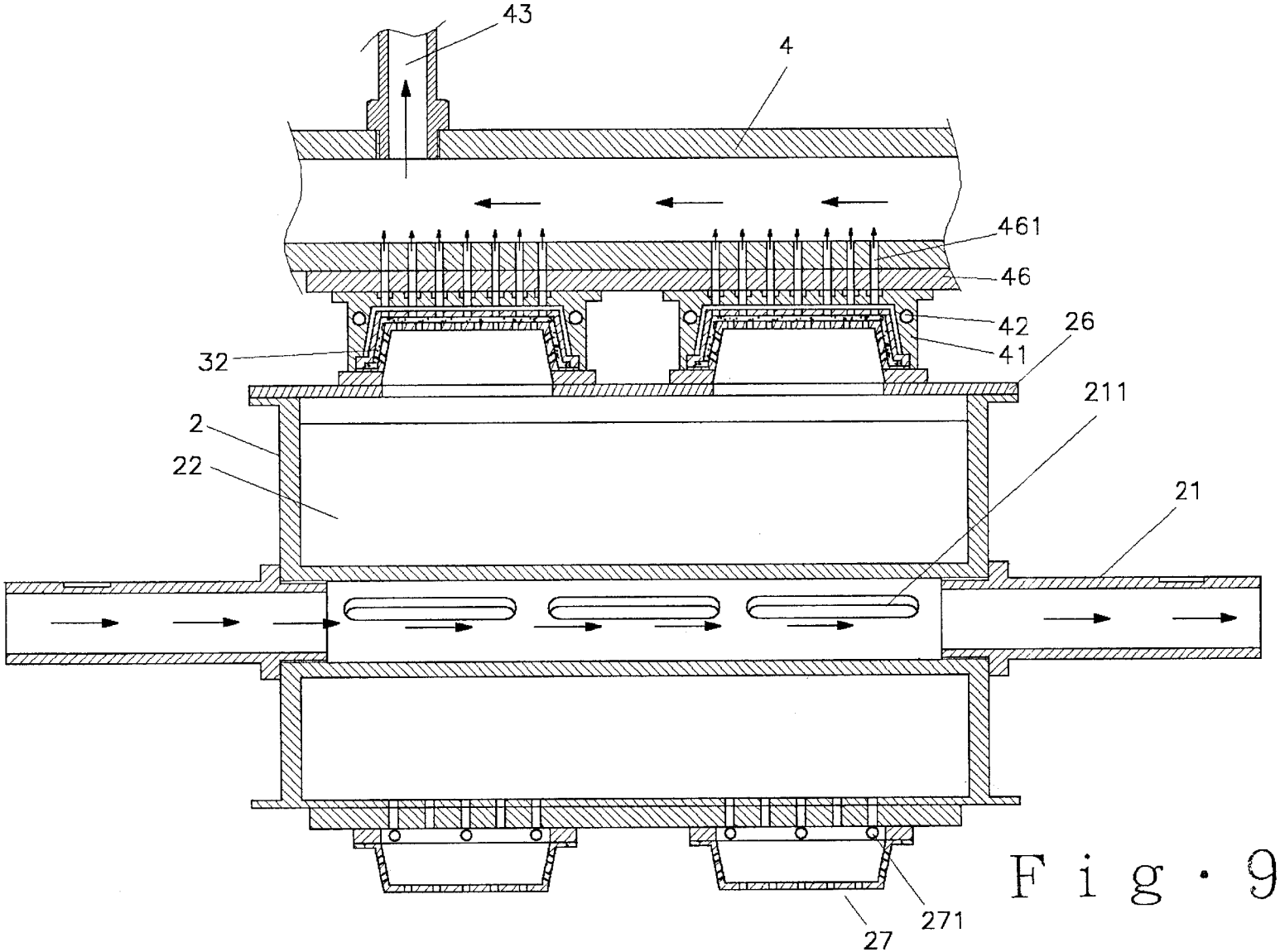
FIG. 9 is a schematic drawing of a net mold of a third preferred embodiment of the present invention.
Figure 10A:
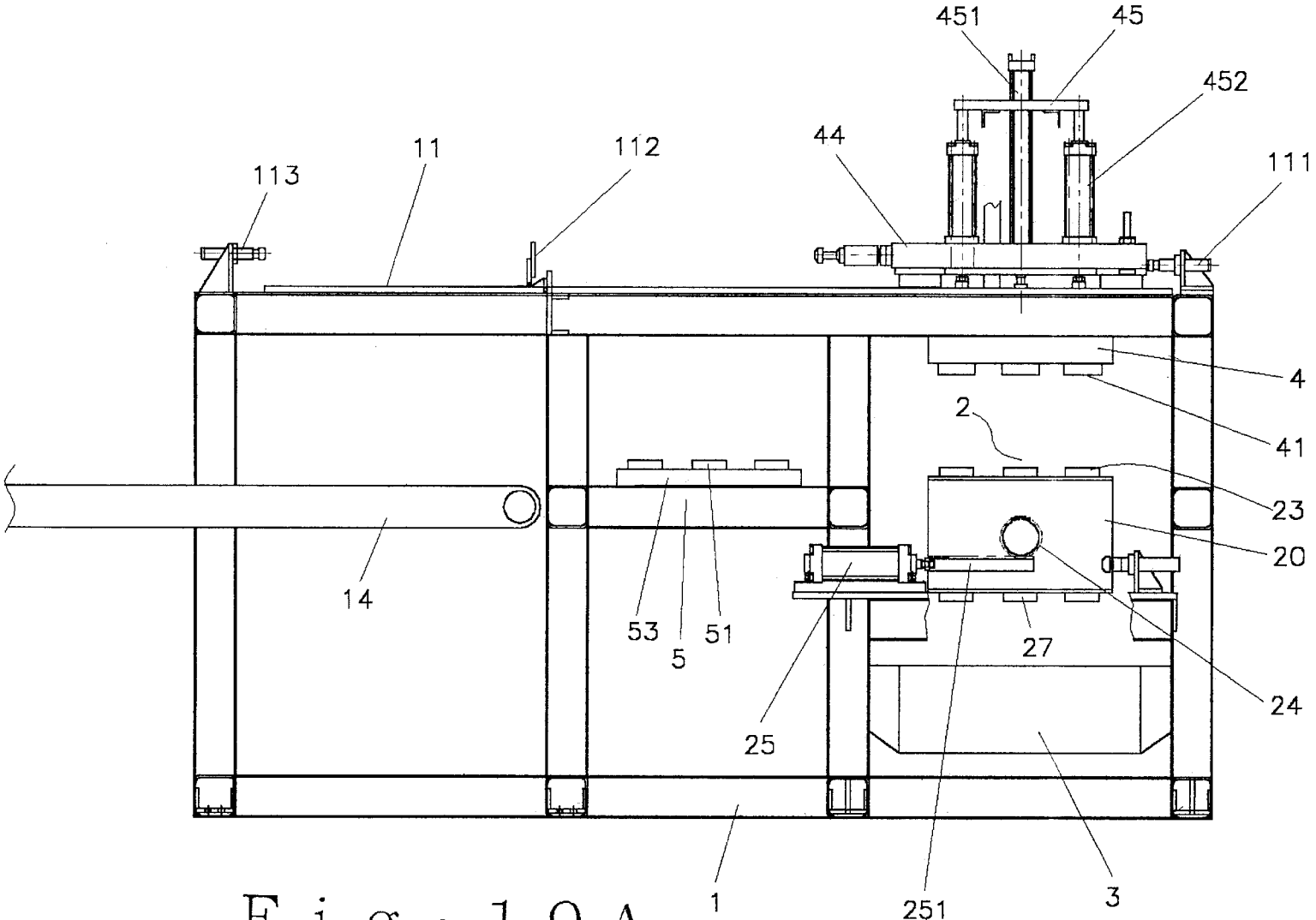
FIG. 10A is a first schematic drawing of the movement of a third preferred embodiment of the present invention.
Figure 10B:
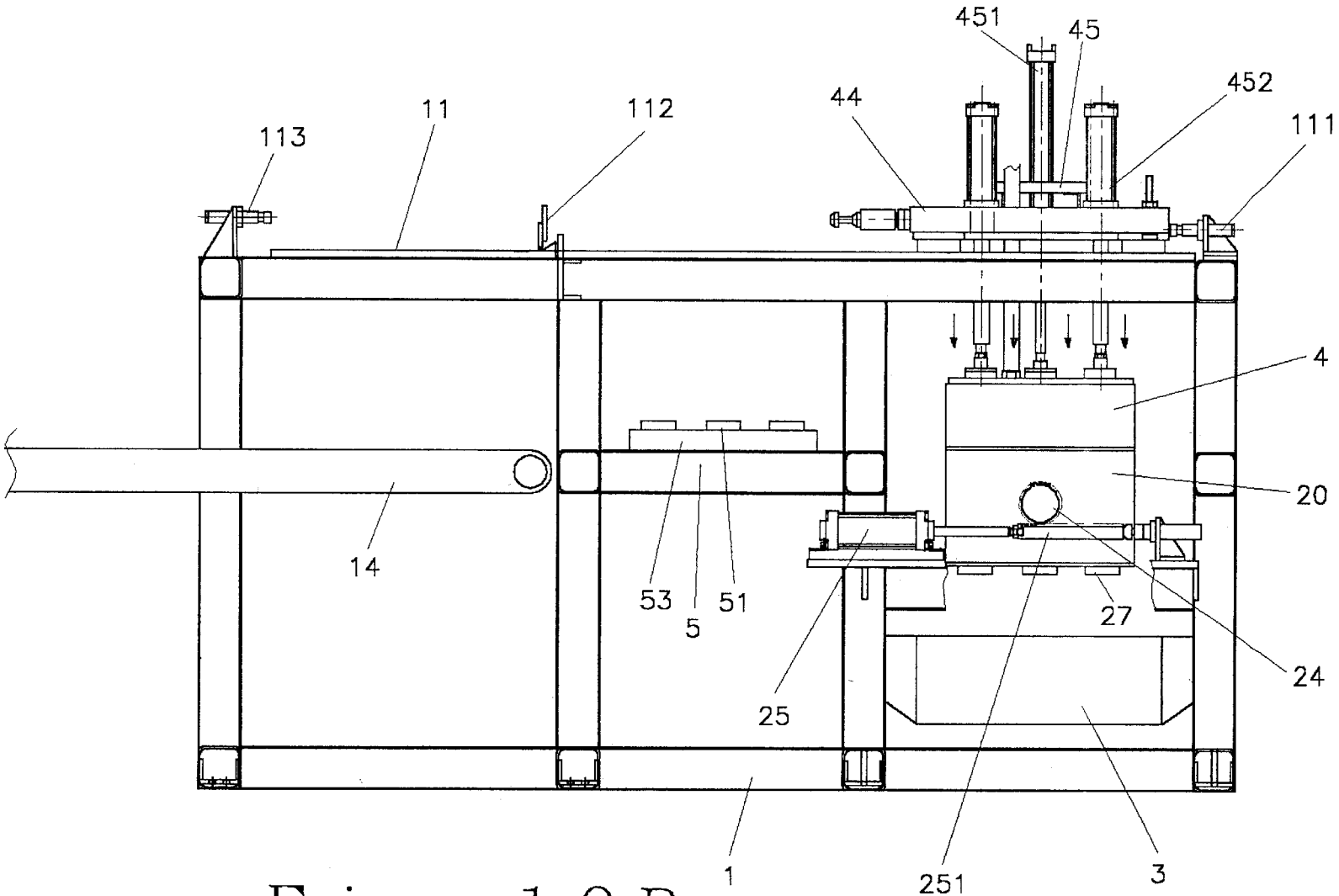
FIG. 10B is a second schematic drawing of the movement of the third preferred embodiment of the present invention.
Figure 10C:
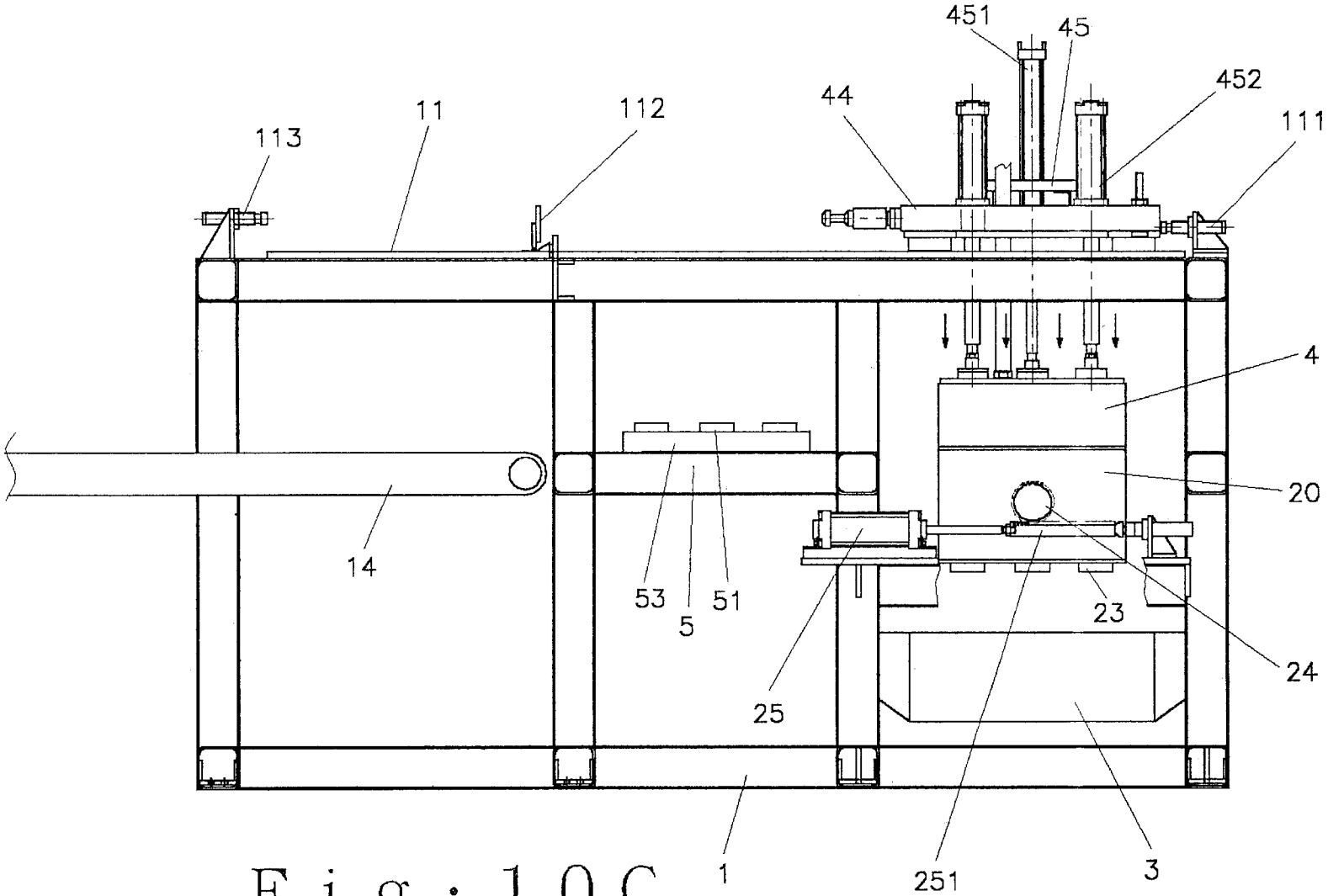
FIG. 10C is a third schematic drawing of the movement of the third preferred embodiment of the present invention.
Figure 10D:
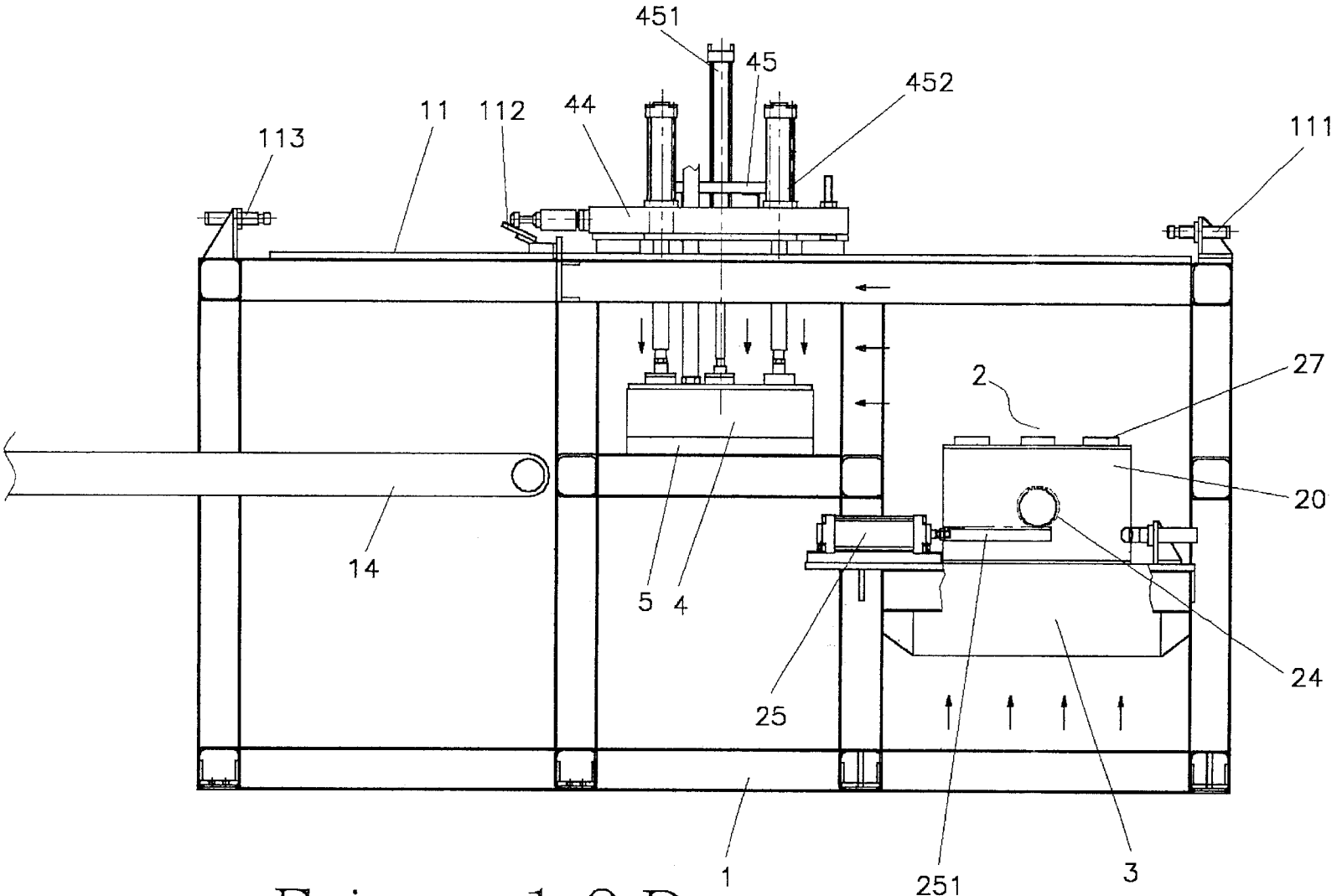
FIG. 10D is a fourth schematic drawing of the movement of the third preferred embodiment of the present invention.

FIG. 9 is a schematic drawing of a net mold of a third preferred embodiment of the present invention, and referring to FIG. 10A through 10C, it's apparent from these drawings that the net mold 2 can be provided with forming members 23 at one side and with forming members 27 identical to the forming members 51 of the lower mold 5 at the other side. The inside of the forming members 27 is also fitted with a heating pipe 271. After the forming members 23 of the net mold 2 suck the pulp in the pulp material container 3 and then reversed to be upwards (as shown in FIG. 10A), the upper mold 4 gives a downward press so that the pulp between the forming members 41, 23 is initially formed (as shown in FIG. 10B). Thereafter, the formed pulp piece 32 is sucked by the forming members 41, and the net mold 2 is turned over to enable the forming members 27 upwards (while the forming members 23 is downward). Then, the upper mold 4 gives a downward press again to enable the forming members 41 to be pressed upon the forming members 27. In cooperation with the preheating of the heating pipes 42, 271, the formed pulp piece 32 therein can be rapidly dried and formed, as shown in FIG. 10C. Thereafter, the forming members 41 suck the formed pulp piece 32 again, and the upper mold 4 shifts to the top of the lower mold 5 to repeat the pressing-down action to enable the forming members 41, 51 to be pressed, closely pressed again, and to dry the formed pulp piece 32 therein, as shown in Fig. 10D.

Figure 11:
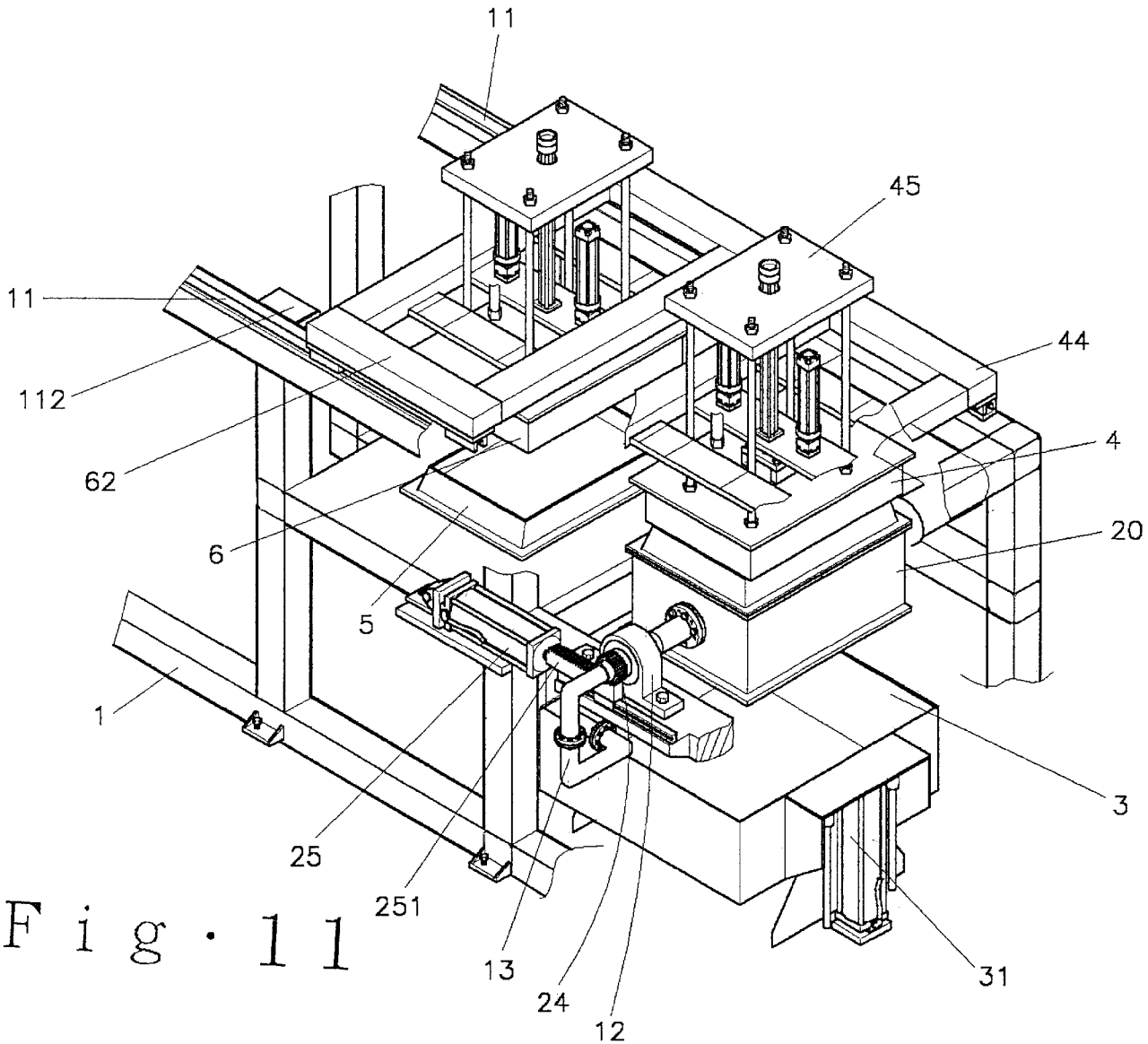
FIG. 11 is a schematic drawing of the structure of a fourth preferred embodiment of the present invention.
Figure 12A:
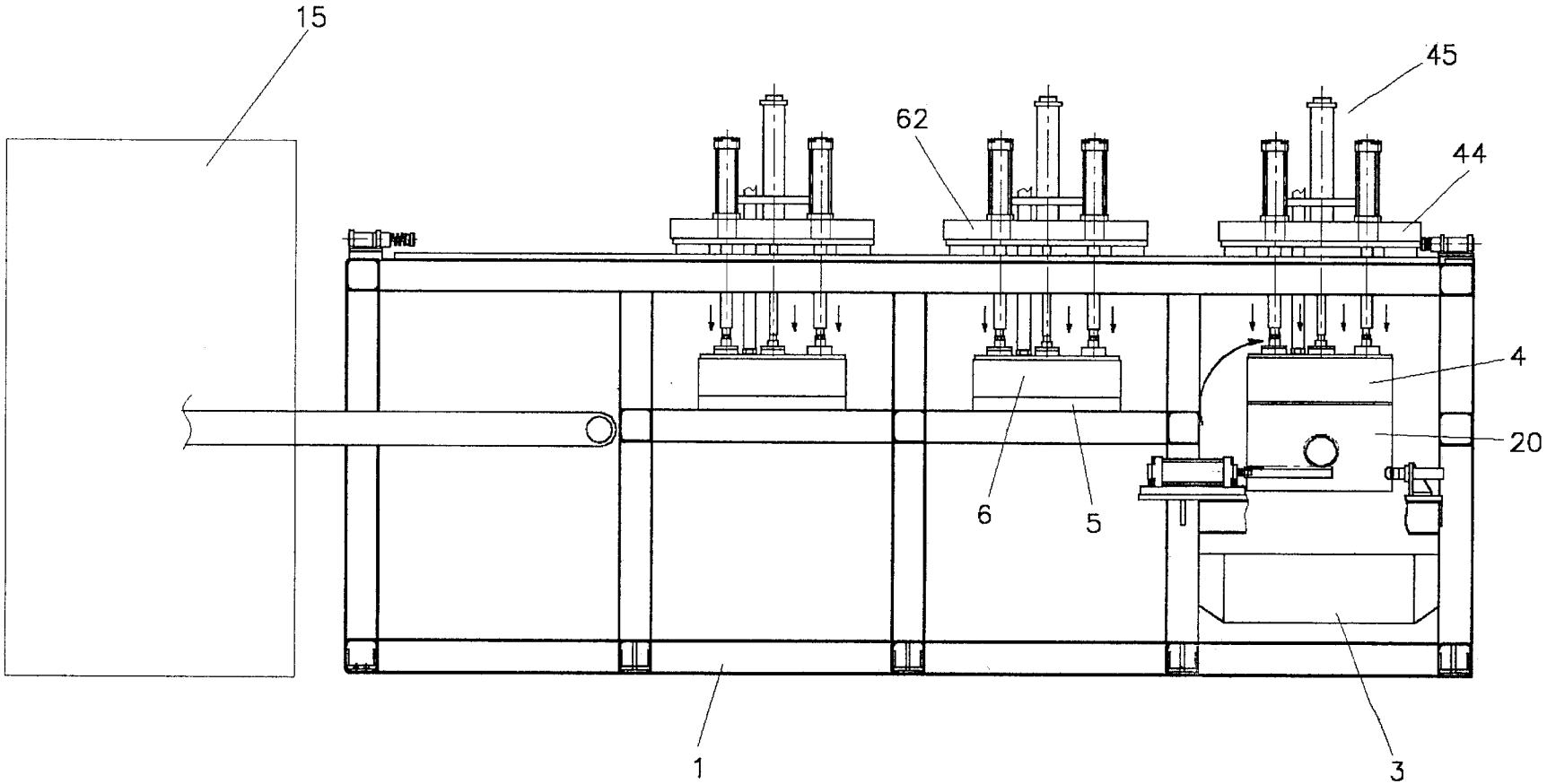
FIG. 12A is a first schematic drawing of the movement of a fourth preferred embodiment of the present invention.
Figure 12B:
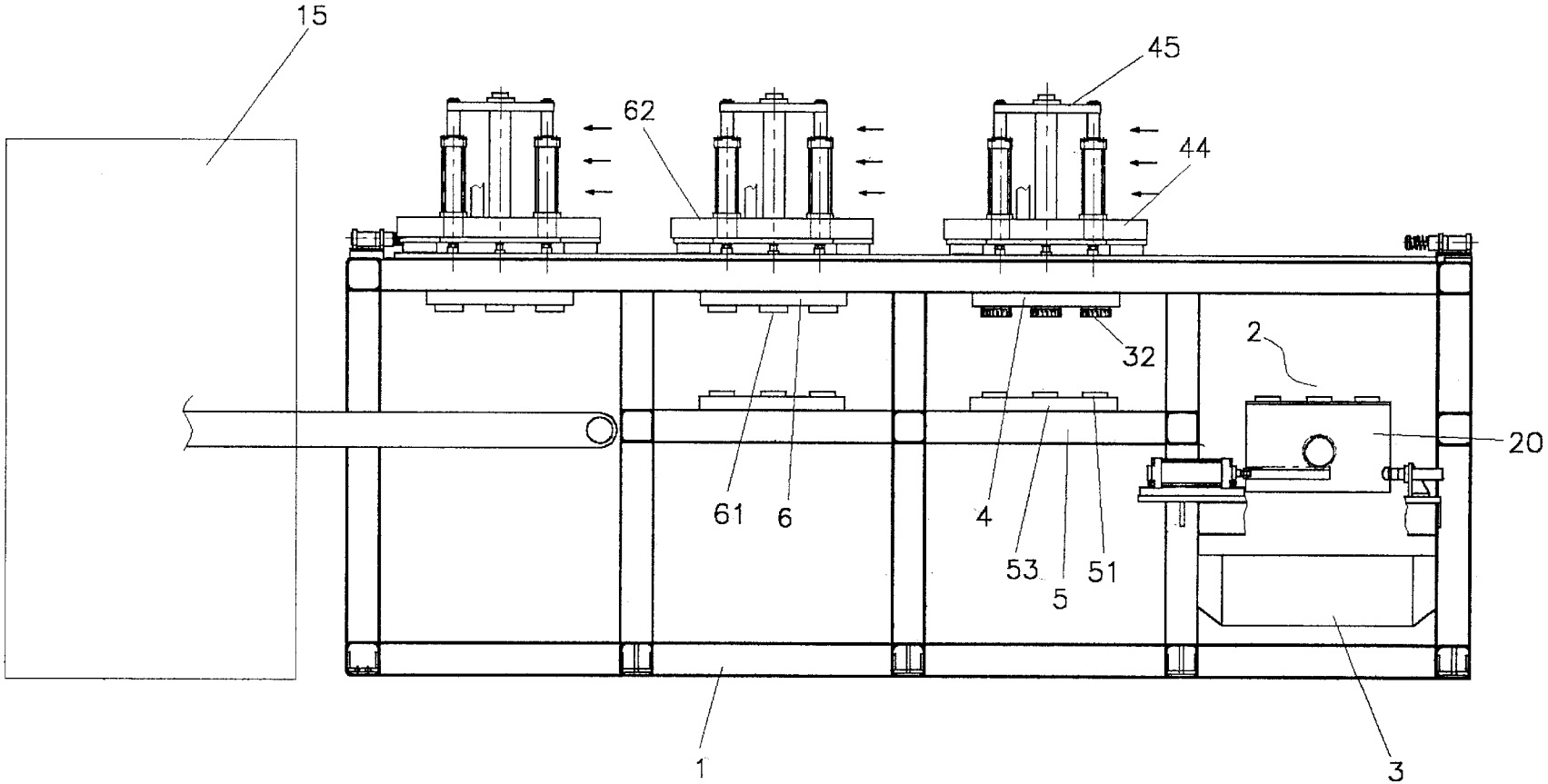
FIG. 12B is a second schematic drawing of the movement of the fourth preferred embodiment of the present invention.
Figure 12C:
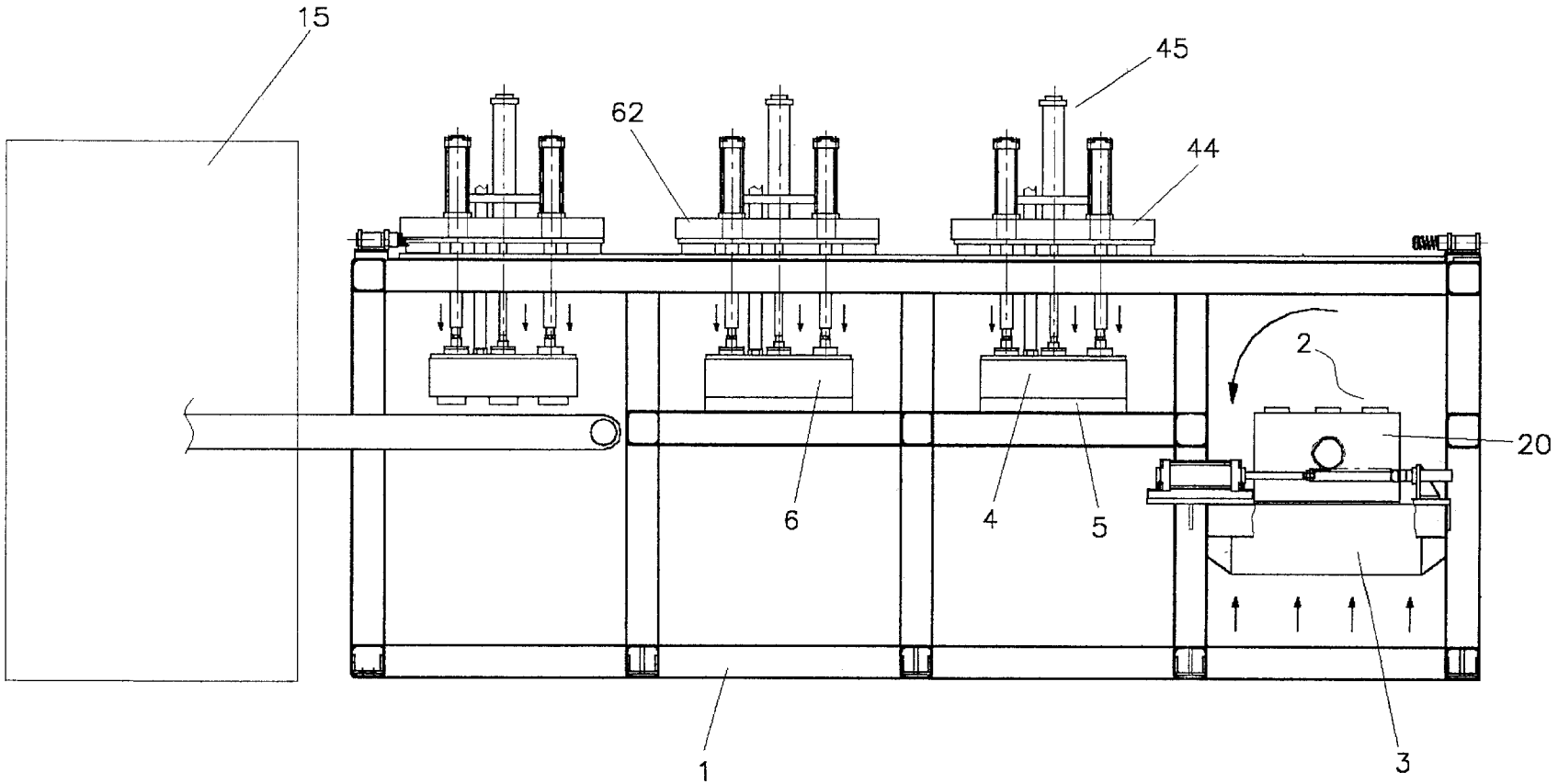
FIG. 12C is a third schematic drawing of the movement of the fourth preferred embodiment of the present invention.
Figure 12D:
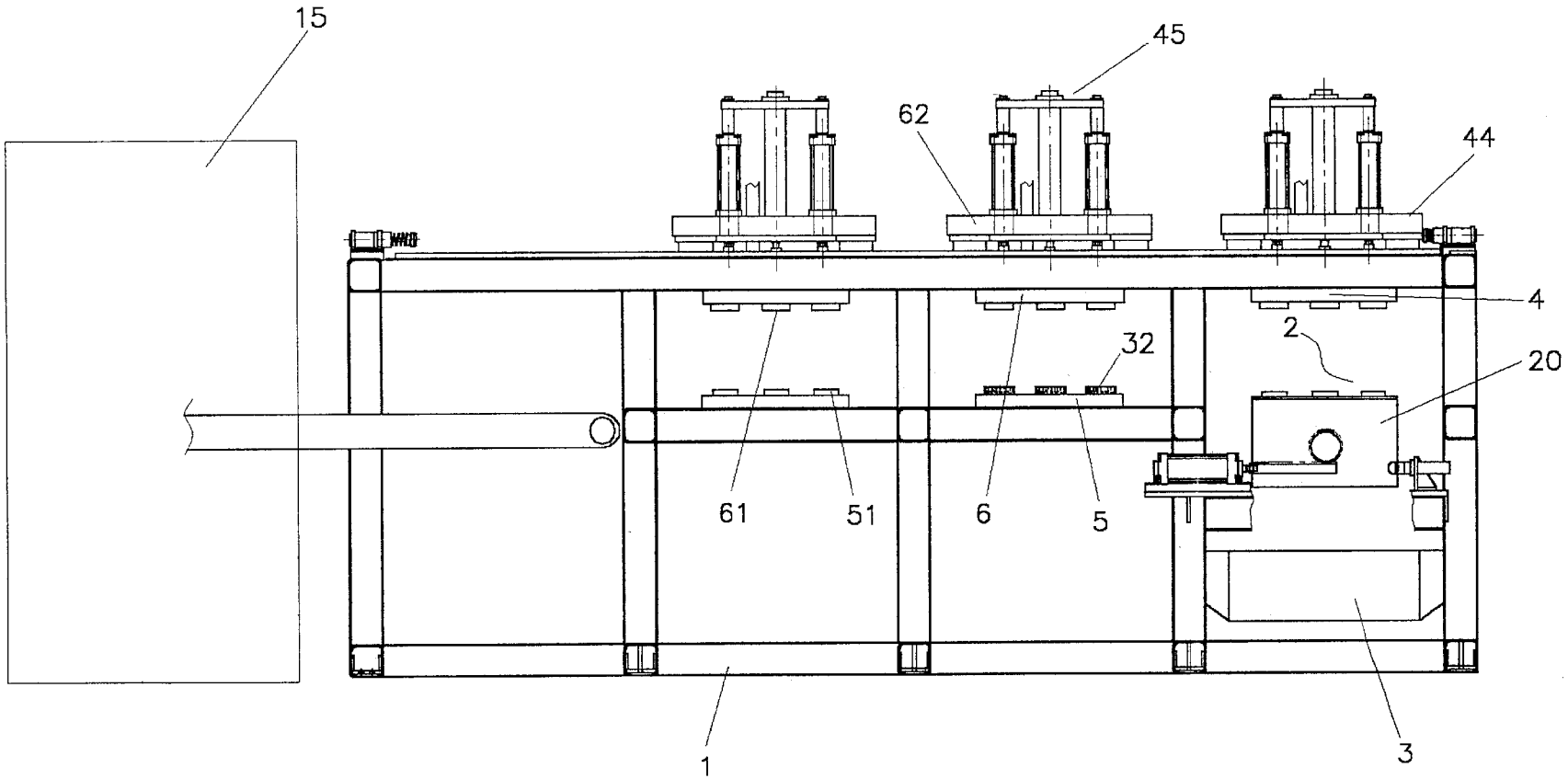
FIG. 12D is a fourth schematic drawing of the movement of the fourth preferred embodiment of the present invention.
Figure 12E:
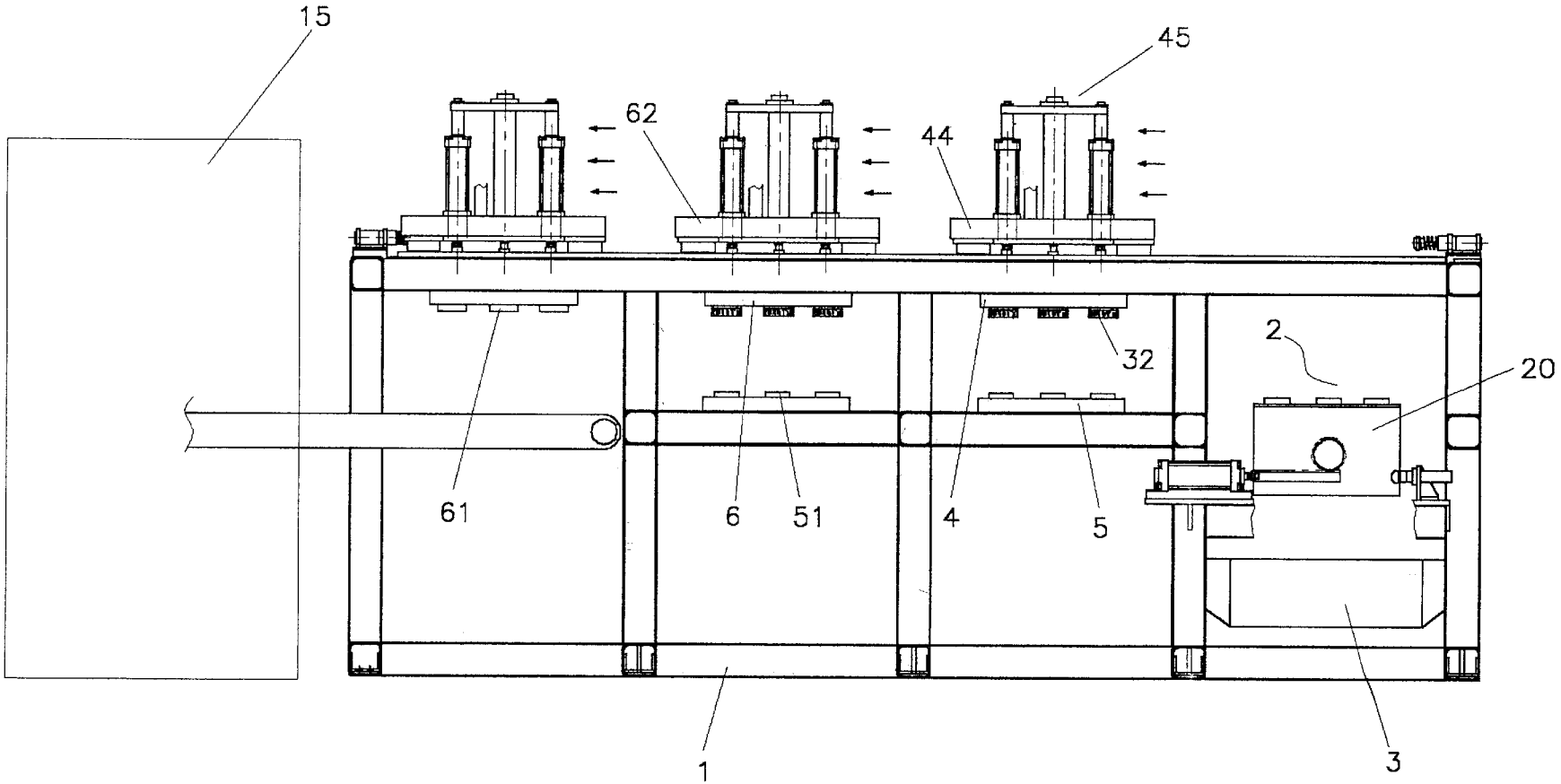
FIG. 12E is a fifth schematic drawing of the movement of the fourth preferred embodiment of the present invention.
Figure 12F:
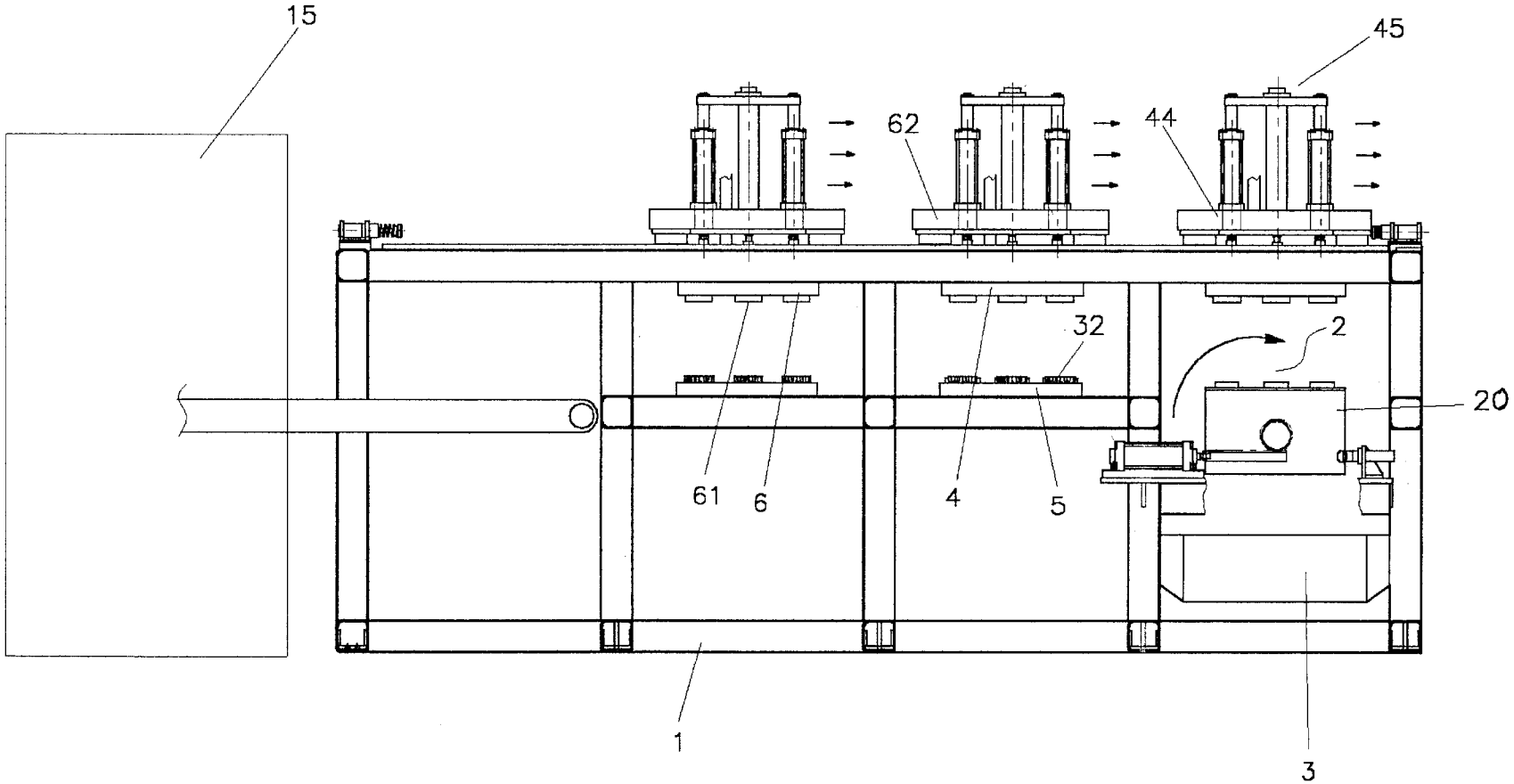
FIG. 12F is a sixth schematic drawing of the movement of the fourth preferred embodiment of the present invention.
Figure 12G:
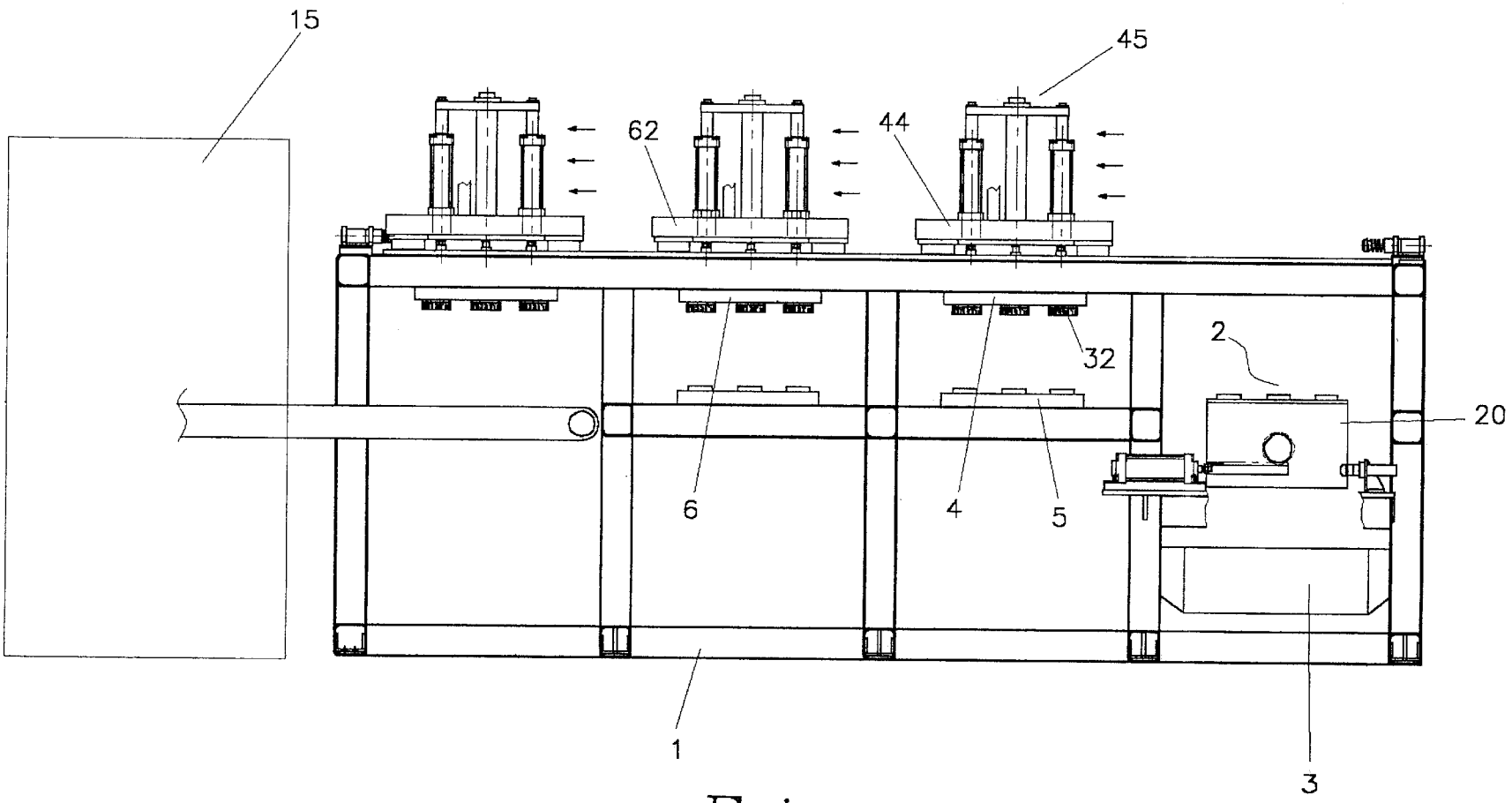
FIG. 12G is a seventh schematic drawing of the movement of the fourth preferred embodiment of the present invention.
Figure 12H:
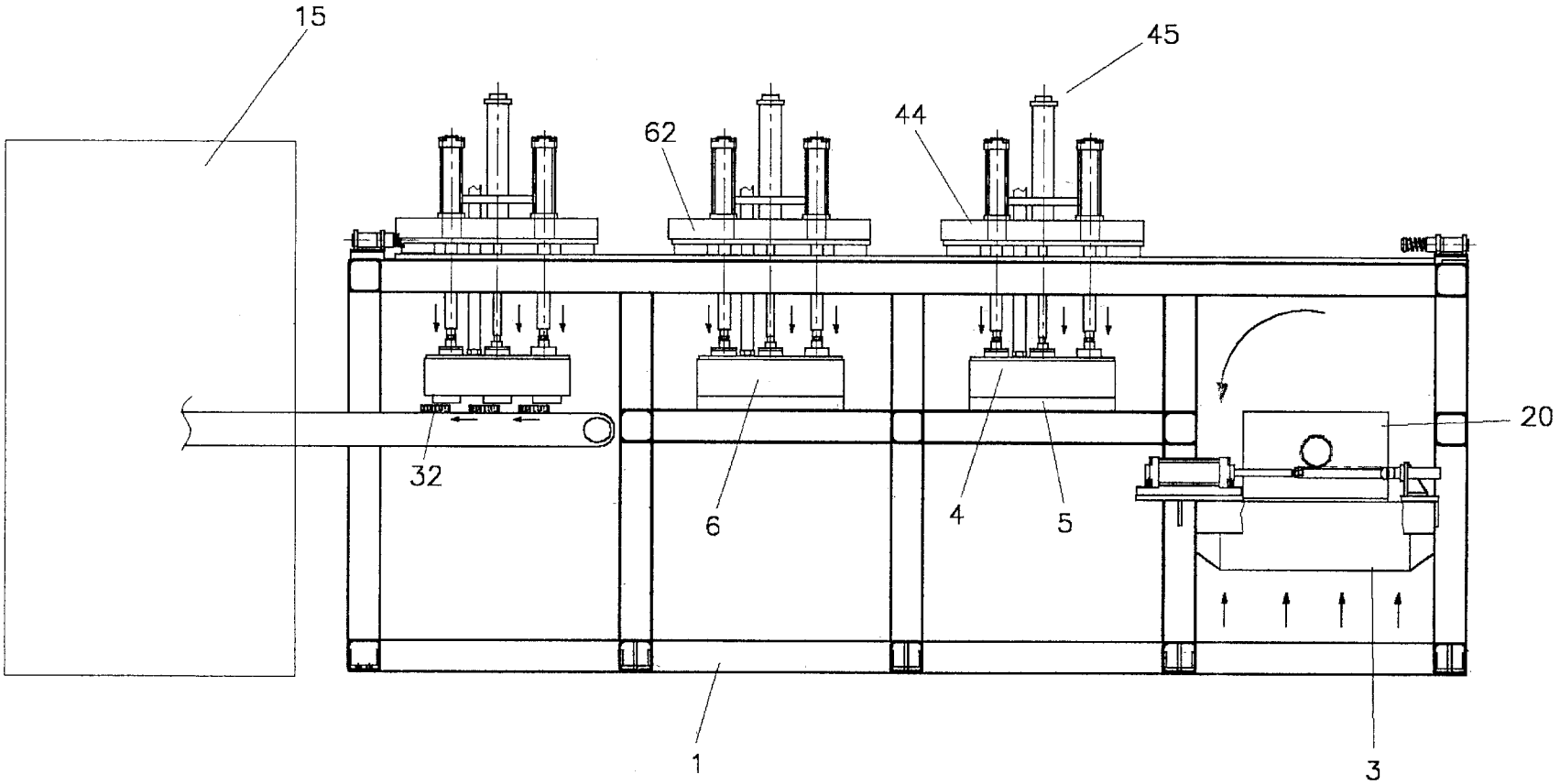
FIG. 12H is a eighth schematic drawing of the movement of the fourth preferred embodiment of the present invention.

FIG. 11 is a schematic drawing of the structure of a fourth preferred embodiment of the present invention, and referring to FIG. 12A through FIG. 12H, it's apparent from the drawings that the upper mold 4 has at least one set of the upper press mold 6 disposed on two guide rails 11 by means of a slide frame 62 and synchronically movable with the upper mold 4 and the slide frame 44. Each upper press mold 6 contains the same number of lower molds 5 at the bottom thereof. After the upper mold 4 completes an initial press action (as shown in FIG. 10A) and sucks the formed pulp piece 32, the cross shift device for the upper mold moves to enable the upper mold 4 and the upper press mold 6 to make a synchronic cross shift (as shown in FIG. 10B). After the upper mold 4 is shifted onto the lower mold 5 to enable the formed pulp piece 32 to be placed on the lower mold 5 (as shown in FIG. 10C), the cross shift device for the upper mold moves in a reverse direction to enable the upper mold 4 to return to the top of the net mold 2 (as shown in FIG. 10D) while the upper press mold 6 also returns to the top of the original lower mold 5. When the upper mold 4 descends again to press upon the pulp material on the net mold 2, the upper press mold 6 at the side of the upper mold 4 also synchronically press upon the formed pulp piece 32 on the lower mold 5 (as shown in FIG. 10A), and when the upper mold 4 sucks one of the formed pulp pieces 32 again, the upper press mold 6 at one side also synchronically sucks the formed pulp piece 32 and makes a cross slide with the upper mold 4 (as shown in FIG. 10E) in order to be moved to the other lower mold 5. By means of the plurality of the upper press molds 6 to make a repeated synchronic press and conveyance (as shown in FIG. 10F and 10G), the last upper press mold 6 can convey the formed pulp piece 32 onto the conveying belt 14, (as shown in FIG. 10H) so that the formed pulp pieces 32 can achieve an excellent drying and solidifying effect in order to apply to different processing methods.

It's to emphasize that when the above-mentioned turnaround table 20 on the machine frame body 1, as shown in FIG. 6A and 6B, is fitted with a lower mold 5 on the other surface thereof having a heating pipe 52 therein (not shown) and when the water of the pulp is squeezed out at the initial press between the net mold 2 and the upper mold 4, the turnaround table 20 will immediately make a 180° turnover to enable the lower mold 5 at the other side of the turnaround table 20 and the upper mold 4 to press together while the heating pipes 42, 52 within the upper mold 4 and the lower mold 5 create a thermal effect in order to speed up the drying process of the water within the formed pulp piece 32. This kind of structure can save the equipment of the lower mold 5 fitted to the original machine frame body 1 and effectively reduce the whole mechanical volume and the number of components. It's also another feature of the present invention.

From the above-mentioned, the pulp-forming mold-releasing machine in accordance with the present invention can really achieve the objects of rapid processing forming, mold-releasing and producing close fiber.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A pulp-forming mold-releasing machine at least comprising:

a machine frame body, at an upper side of said machine frame body is fitted with two parallel extending guide rails; a middle section of said machine frame body comprises two bearing blocks each corresponding to a respective one of said guide rails; a vent pipe disposed at a center of each of said bearing blocks; a conveying belt disposed between said bearing blocks;

a net mold mounted at one side of a turnaround table and having protruding forming members, the surface of said net mold provided with air holes for sucking and blowing air; a pipe shaft disposed through two sides of said net mold, and two pipe shafts connected to an inside of said net mold; each of the two pipe shafts penetrating through a prearranged bearing within a respective one of said bearing blocks and connected with said vent pipe; an outer end member of said pipe shaft connected with a rotatable driving device through which the net mold is rotatable on said pipe shaft:

a pulp material container disposed under the net mold and two sides thereof being movable upwards and downwards by a plurality of lifting devices for said pulp material container;

an upper mold connected with lifting devices for said upper mold and located on a side frame; said lifting devices for the upper mold including an air-oil-pressure diversion cylinder and a pneumatic pressure cylinder; said slide frame being placed on said two guide rails and movable thereon; a plurality of forming members being mounted on a bottom side of the upper mold; each of said forming members having a heating pipe therein; a bottom side of said forming member comprising a slotted forming space in which a plurality of air holes are provided for sucking or blowing air; a cross shift device for said upper mold to enable said slide frame to slide on the guide rails while said lifting devices for said upper mold enables said upper mold to move upwards or downwards;

a lower mold disposed at a position of equal height with said net mold of said machine frame body; an inside of said lower mold fitted with a heating pipe; an upper side of the lower mold provided with a plurality of forming members, inside and outside of said forming members having a plurality of externally connected air holes;

wherein, when said pump material container ascends to approach the lower side of the net mold, said pipe shaft of said net mold begins to suck air to enable the pulp to be sucked on the surface of said forming members of the net mold, and thereafter, said net mold is rotated 180° about an axis in the horizontal plane to enable said sucked pulp upwards; said forming members of said upper mold is moved by said pneumatic cylinder of said lifting device of said upper mold to shift downwards on top of said pulp; an air-oil-pressure diversion cylinder is pressed pneumatically to dehydrate the pulp; after initial forming, said upper mold begins to pump air to suck the formed pulp which will then be shifted by said upper mold to the upper side of the lower mold; thereafter, said upper mold is pressed by oil pressure by said air-oil-pressure diversion cylinder to enable the fiber in the formed pulp pieces to be closely formed; and a heating effect is created by said heating pipes within said upper mold and said lower mold in order to achieve a rapid drying effect.

2. The pulp-forming mold-releasing machine as claimed in claim 1, wherein said rotatable driving device drives a toothed drive bar which is engaged with a toothed wheel together; said toothed wheel is disposed at the end of said pipe shaft at the side of said net mold so that said net mold is rotatable by means of said rotatable driving device.

3. The pulp-forming mold-releasing machine as claimed in claim 2, wherein said rotatable driving device is a pneumatic cylinder.

4. The pulp-forming mold-releasing machine as claimed in claim 1, wherein said pulp material container is a pneumatic cylinder.

5. The pulp-forming mold-releasing machine as claimed in claim 1, wherein a shock absorber is respectively disposed on the outside of the end of two guide rails at the top of said machine frame body in order for said slide frame of said upper mold to contact therewith and to be located on the upper side of said net mold or said conveying belt.

6. The pulp-forming mold-releasing machine as claimed in claim 1, wherein a upper mold seat plate is disposed between said upper mold and said forming members, and wherein a plurality of breather holes connected to said air holes of said forming members are well-distributed on said upper mold seat plate.

7. The pulp-forming mold-releasing machine as claimed in claim 1, wherein said net mold is provided with forming members to suck pulp at one side thereof and with forming members identical to said forming members of said lower mold in structure at the other side; and wherein the pulp can be formed in a preset way and dried through the turnover of said net mold in cooperation with the repeated pressing-down of the upper mold.

8. The pulp-forming mold-releasing machine as claimed in claim 1, wherein said net mold is fitted with at least one lower mold at the side thereof, and wherein said lower mold is provided with a upper press mold at the upper side of corresponding amount synchronically movable with said upper mold, and wherein the synchronic motion between said upper press mold and said upper mold enables said formed pulp pieces continuously movable on each lower mold and enables them to be repeatedly pressed together-by each upper press mold in order to achieve a better dehydrated effect.

9. The pulp-forming mold-releasing machine as claimed in claim 1, wherein said turnaround table has said net mold fixed at one side thereof and a lower mold at the other side thereof.

10. The pulp-forming mold-releasing machine as claimed in claim 1, wherein the other side of said turnaround table can be fitted without said lower mold.

* * * * *